US011523724B2

(12) United States Patent
Meisenbacher et al.

(10) Patent No.: US 11,523,724 B2
(45) Date of Patent: Dec. 13, 2022

(54) SURFACE CLEANING MACHINE WITH COVER DEVICE FOR DIRTY FLUID RESERVOIR DEVICE

(71) Applicant: Alfred Kärcher SE & Co. KG, Winnenden (DE)

(72) Inventors: Marc Meisenbacher, Fellbach (DE); Christoph Rufenach, Korntal-Muenchingen (DE); Tobias Palmer, Baltmannsweiler (DE); Andreas Mueller, Oppenweiler (DE); Mathias Frisch, Backnang-Maubach (DE)

(73) Assignee: Alfred Kärcher SE & Co. KG, Winnenden (DE)

( * ) Notice: Subject to any disclaimer, the term of this patent is extended or adjusted under 35 U.S.C. 154(b) by 376 days.

(21) Appl. No.: 16/786,550

(22) Filed: Feb. 10, 2020

(65) Prior Publication Data

US 2020/0170472 A1 Jun. 4, 2020

Related U.S. Application Data

(63) Continuation of application No. PCT/EP2017/070435, filed on Aug. 11, 2017.

(51) Int. Cl.
*A47L 11/40* (2006.01)
*A47L 11/292* (2006.01)

(52) U.S. Cl.
CPC ..... *A47L 11/292* (2013.01); *A47L 11/4016* (2013.01); *A47L 11/4025* (2013.01); *A47L 11/4041* (2013.01); *A47L 11/4061* (2013.01); *A47L 11/4066* (2013.01); *A47L 11/4088* (2013.01); *A47L 2201/04* (2013.01)

(58) Field of Classification Search
CPC . A47L 11/4016; A47L 11/4041; A47L 11/292
See application file for complete search history.

(56) References Cited

U.S. PATENT DOCUMENTS

| | | | |
|---|---|---|---|
| 3,789,449 | A | 2/1974 | MacFarland et al. |
| 4,173,054 | A | 11/1979 | Ando |
| 4,875,246 | A | 10/1989 | MacGregor |

(Continued)

FOREIGN PATENT DOCUMENTS

| | | | |
|---|---|---|---|
| CN | 1557575 | A | 12/2004 |
| CN | 201 197 698 | Y | 2/2009 |

(Continued)

*Primary Examiner* — Michael D Jennings
(74) *Attorney, Agent, or Firm* — Womble Bond Dickinson (US) LLP

(57) ABSTRACT

A surface cleaning machine is provided, including a cleaning head having at least one driven cleaning roller unit, a dirty fluid reservoir device arranged on the cleaning head, and a scraping guide device for dirty fluid that acts on the at least one cleaning roller unit, wherein the dirty fluid reservoir device has a container device for dirty fluid and a cover device for the container device, wherein a duct device for cleaning liquid is arranged on the cover device, and wherein there is arranged on the cover device an orifice device which is fluidically connected to the duct device and by means of which cleaning liquid is applicable to the at least one cleaning roller unit.

44 Claims, 15 Drawing Sheets

(56) References Cited

U.S. PATENT DOCUMENTS

| | | | | |
|---|---|---|---|---|
| 5,657,504 | A | 8/1997 | Khoury | |
| 6,026,529 | A | 2/2000 | Caruso | |
| 7,665,174 | B2 | 2/2010 | Basham et al. | |
| 7,921,497 | B2 | 4/2011 | Cook et al. | |
| 9,289,105 | B2 | 3/2016 | Moes | |
| 9,999,332 | B2 | 6/2018 | Braendle et al. | |
| 10,130,230 | B2 | 11/2018 | Moser et al. | |
| 10,327,619 | B2 | 6/2019 | Moser et al. | |
| 10,349,797 | B2 | 7/2019 | Moser et al. | |
| 10,362,920 | B2 | 7/2019 | Moser et al. | |
| 2005/0160553 | A1* | 7/2005 | Gregory | A47L 7/0038 15/320 |
| 2014/0259514 | A1* | 9/2014 | Vail | A47L 11/408 15/322 |
| 2015/0257621 | A1* | 9/2015 | Bantum | A47L 11/4088 15/320 |
| 2016/0345795 | A1 | 12/2016 | Manning | |
| 2017/0215678 | A1 | 8/2017 | Moser et al. | |
| 2018/0228331 | A1 | 8/2018 | Moser et al. | |

FOREIGN PATENT DOCUMENTS

| | | |
|---|---|---|
| DE | 20 2016 105 301 U1 | 10/2016 |
| WO | WO 2005/087075 | 9/2005 |
| WO | WO 2010/041185 | 4/2010 |
| WO | WO 2013/106762 | 7/2013 |

* cited by examiner

SURFACE CLEANING MACHINE WITH COVER DEVICE FOR DIRTY FLUID RESERVOIR DEVICE

CROSS-REFERENCE TO RELATED APPLICATIONS

This application is a continuation of international application number PCT/EP2017/070435 filed on Aug. 11, 2017, which is incorporated herein by reference in its entirety and for all purposes.

BACKGROUND OF THE INVENTION

The invention relates to a surface cleaning machine, including a cleaning head having at least one driven cleaning roller unit, a dirty fluid reservoir device arranged on the cleaning head, and a scraping guide device for dirty fluid that acts on the at least one cleaning roller unit.

WO 2010/041185 A1 discloses a surface cleaning machine with rotating brushes.

U.S. Pat. No. 7,665,174 B2 discloses a cleaning head for a floor cleaning machine.

U.S. Pat. No. 4,173,054 discloses a floor cleaner that includes a handle, a main body, a roller mechanism with a roller having a cleaning belt, a scraper, and a dirty fluid receptacle.

WO 2013/106762 A2 discloses a surface cleaning machine with a cleaning roller and a drive unit for driving the cleaning roller. A dirt tray into which the cleaning roller brushes dirt as it rotates is provided. It is possible for the dirt tray to be opened.

U.S. Pat. No. 7,921,497 B2 discloses a floor scrubbing device that is operated manually and includes a drive roller coupled to a scrubbing roller.

The applications PCT/EP2015/073275, PCT/EP2015/072929, PCT/EP2015/073529, PCT/EP2015/073116, PCT/EP2015/073478, which are not prior publications, disclose surface cleaning machines. PCT/EP2015/073315, which is not a prior publication, likewise discloses a surface cleaning machine.

U.S. Pat. No. 4,875,246 discloses a portable floor cleaning device that has a roller driven by an electric motor.

DE 20 2009 013 434 U1 discloses a device for the wet cleaning of a floor using a brush that is rotatable about an axis of rotation.

CN 201 197 698 Y discloses a cleaning machine.

U.S. Pat. No. 6,026,529 discloses a device for cleaning floors or other hard surfaces.

WO 2005/087075 A1 discloses a floor cleaning machine having a handle that is arranged to pivot on a base.

WO 2015/086083 A1 discloses a further floor cleaning machine.

U.S. Pat. No. 3,789,449 discloses a hard floor cleaning device.

SUMMARY OF THE INVENTION

In accordance with an embodiment of the invention, a surface cleaning machine is provided that takes a simple and compact form.

In accordance with an embodiment of the invention, the dirty fluid reservoir device has a container device for dirty fluid and a cover device for the container device, in that a duct device for cleaning liquid is arranged on the cover device, and in that there is arranged on the cover device an orifice device which is fluidically connected to the duct device and by means of which cleaning liquid is applicable to the at least one cleaning roller unit.

Integrating a duct device into the cover device and, further, integrating the orifice device into the cover device allows the surface cleaning machine and in particular the cleaning head, with its dirty fluid reservoir device, to take a simple and compact form.

Functional parts of the surface cleaning machine that are essential for providing cleaning liquid to a cleaning roller unit are integrated into the dirty fluid reservoir device.

This also makes it possible to clean these essential parts, and in particular the duct device with the orifice device, in a simple manner.

Moreover, the container device can then take a form having a large receiving capacity.

By providing a scraping guide device, which is then in particular arranged on the dirty fluid reservoir device, dirty fluid can be scraped off the cleaning roller unit, in particular without forming bubbles, and conveyed to the dirty fluid reservoir device.

Here, it is provided in particular for the orifice device for cleaning liquid to be arranged and to take a form such that cleaning liquid is applicable to at least approximately an entire facing (trimming) length of the at least one cleaning roller unit. This produces optimized cleaning results at the same time as a dirty fluid reservoir device and cleaning head that take a structurally simple form.

In that case, it is favorable if the orifice device has at least one orifice slot. In particular, in relation to a direction transverse to an axis of rotation, only a single orifice slot is provided on the cover device. (In relation to a direction along the axis of rotation of the corresponding cleaning roller unit, it is possible to provide one orifice slot or a plurality of spaced-apart orifice slots.) This produces a simple structural arrangement with a simple configuration for applying cleaning liquid.

It is favorable in that case if the at least one orifice slot is of a length that corresponds to at least 80% and preferably at least 90% and preferably 100% of a facing length of a facing region of the at least one cleaning roller unit with which the at least one orifice slot is associated. This produces optimized cleaning results at the same time as a structurally simple arrangement.

In particular, a direction of longitudinal extent of the at least one orifice slot is oriented at least approximately parallel to an axis of rotation of the associated at least one cleaning roller unit. This allows optimized wetting of a facing of the cleaning roller unit to be achieved, in order in turn to give optimized cleaning results.

In principle, the dirty fluid reservoir device may also be emptied via its inlet orifice.

It is favorable if the cover device is arranged detachably and/or movably on the container device and, when the cover device is open, one or more receiving chamber spaces of the container device are accessible. A movable cover device takes a pivotal form or the form of a slide cover, for example. This allows the container device to be emptied in a simple manner. Further, the container device and the cover device can be cleaned in a simple manner.

In a structurally simple embodiment, for dirty fluid to enter the container device, an inlet orifice of the dirty fluid reservoir device is arranged on the container device and/or the cover device. This allows the number of parts required to be minimized. Further, it allows the "dirtied region" on the cleaning head and the dirty fluid reservoir device to be minimized, in order thus also to enable cleaning, for example by washing out, in a simple manner.

It is favorable if the dirty fluid reservoir device as a whole or the container device is arranged detachably on the cleaning head. In this way, they are configured to be simple to empty and clean.

It is in particular provided for the duct device to be fluidically connected to a reservoir device for cleaning liquid. This allows cleaning liquid to be applied to the at least one cleaning roller unit in a simple manner.

In one embodiment, the scraping guide device is arranged on the cover device. This produces a simpler structural arrangement. The number of parts required can be minimized.

In that case, it is favorable if the scraping guide device forms a wall for the duct device and/or for the orifice device for cleaning liquid. This allows the number of parts required to be minimized. On the one hand, the duct device may be formed in a simple manner, and on the other it is possible to obtain a separation between the orifice device, as the outlet orifice device for cleaning liquid, and the inlet orifice, as the inlet for dirty fluid.

In particular in that case, the scraping guide device is arranged between the orifice device for cleaning liquid and an inlet orifice for dirty fluid to the dirty fluid reservoir device. This produces a simple structural arrangement.

For the same reason, it is favorable if the scraping guide device has a guide surface for cleaning liquid, for supply to the cleaning roller unit. This produces a simple structural arrangement.

In that case, it is also favorable if the scraping guide device forms, at least in part, a separating wall between the duct device, for supplying cleaning liquid to the cleaning roller unit, and an inlet orifice or inlet region of the dirty fluid reservoir device. The number of parts required can be minimized.

In that case, it is in particular favorable if the scraping guide device has a first side with a diverting surface and/or baffle for dirty fluid, and a second side, opposite the first side, with a diverting surface for cleaning liquid. This allows the number of parts required to be kept small.

Optimized removability of dirty fluid, and in particular removability without bubbles, is produced if the cleaning head has a holding region for the cleaning roller unit, and the scraping guide device has a region that projects into the holding region. In this way, it is in particular possible in a simple manner to achieve a situation in which the scraping guide device projects in a facing of the at least one cleaning roller unit specifically in order to be able to remove (scrape off) dirty fluid.

It is favorable if at least one element for retaining dirty fluid in the dirty fluid reservoir device is seated on the cover device and/or the container device. By way of a retaining element of this kind, it is possible for example, when the dirty fluid reservoir device or the container device is taken out, to prevent collected dirty fluid from escaping, or at least to make this more difficult. Further, the retaining element may also serve to protect against slopping during operation of the surface cleaning machine.

It is for example provided for a retaining element to be arranged on the cover device and, when the cover device is seated on the container device, for the at least one retaining element to penetrate into an associated receiving chamber of the container device. This produces a retaining function. The retaining element is separable from the container device by the separable cover device.

It is favorable if the at least one retaining element covers a sub-region of at least one receiving chamber of the container device, wherein one or more openings that are fluidically connected to the sub-region are arranged on the at least one retaining element, and/or one or more openings that are fluidically connected to the sub-region are arranged between the at least one retaining element and a receiving chamber wall. This allows a duct or a plurality of ducts to be formed, through which dirty fluid is suppliable to the corresponding receiving chamber. The at least one retaining element fulfils its retaining function. Introduction into a receiving chamber (collecting chamber) is possible through the at least one opening.

In that case, it is advantageous if the at least one opening is at a lower gravitational potential, at least in a sub-region, than an inlet orifice of the dirty fluid reservoir device with reference to a normal operation of the surface cleaning machine. As a result, dirty fluid removed from the at least one cleaning roller unit can flow into a corresponding receiving chamber "by itself" (under the action of gravity).

It is further favorable if at least one duct for dirty fluid is arranged between the at least one retaining element and an underside of the cover device. As a result, dirty fluid can flow into its corresponding receiving chamber, with the duct forming a guide.

In that case, it is advantageous if the at least one duct opens into an inlet orifice of the dirty fluid reservoir device on the inlet side, in order to be able to collect dirty fluid in a simple manner.

Further, and for the same reason, it is favorable if the at least one duct opens into one or more openings to a sub-region of the at least one receiving chamber of the container device on the outlet side. This optimizes suppliability of dirty fluid for collection in the container device.

In one embodiment, the at least one retaining element is spaced from an underside of the cover device (without the at least one retaining element) by one or more pillars on the cover device. This produces easy cleaning. Further, a duct can be formed between the underside and the retaining element.

In an alternative or additional embodiment, the at least one retaining element is arranged movably and/or removably on the container device. If for example the container device is separated from the cleaning head, with the cover device removed, the at least one retaining element may fulfil its retaining function in this case as well. As a result of the movability and/or removability, it can then be moved such that the container device can be emptied and/or cleaned.

In one embodiment, the at least one retaining element is arranged on the container device such that it is pivotal and in particular pivotal about a hinge. It may be pivoted such that a corresponding receiving chamber is substantially covered (apart from one or more openings for the purpose of supply). In that case, for the purpose of emptying the corresponding receiving chamber, the at least one retaining element is pivoted into an open position. In particular, the open position here is a type of latched position.

In one embodiment, the dirty fluid reservoir device has a plurality of separate receiving chambers that are arranged next to one another in particular in a direction parallel to an axis of rotation of the cleaning roller unit. However, they may also be arranged in a direction perpendicular to this axis of rotation. For example, a receiving chamber is associated with its own cleaning roller unit or, in the case of a multi-part form of a cleaning roller unit, there is associated with each part of the cleaning roller unit a corresponding receiving chamber.

In that case, it is advantageous if the cover device is a common cover device for the receiving chambers, and in particular is formed by a single element. In that case, a corresponding common orifice device is also arranged on the cover device, for the at least one rotary roller unit.

In particular in that case, the cover device includes at least one of the following elements for each receiving chamber: an orifice slot, a scraping guide device element (as part of a scraping guide device), a duct device region for cleaning liquid (as part of a duct device), a retaining element for a corresponding receiving chamber space. This produces a simple structural arrangement.

In particular here, between spaced-apart receiving chambers there is arranged, at least in part, a device for transmitting torque to the cleaning roller unit. In this way, a type of center drive can be produced for the cleaning head. The result is that edges are easy to clean.

In one embodiment, there is arranged on the container device a lug that delimits a holding region for the cleaning roller unit and has in particular a bearing surface for the cover device. For example, an inlet orifice for dirty fluid can be formed by means of the lug. Further, it can be used to perform or support closure of the container device by the cover device, which is set down thereon correspondingly.

In one embodiment, a first fixing device is provided that fixes the container device to the cleaning head, and a second fixing device is provided that fixes the cover device to the container device, in particular directly. This makes it possible for example to separate a dirty fluid reservoir device in which the cover device on the container device is closed from the cleaning head, or to insert it therein, as a whole.

In an advantageous embodiment, a fixing device for the cover device is provided that fixes the cover device directly to the cleaning head. It is thus possible for example, by way of the cover device, to fix the container device to the cleaning head at least in a removing direction or an inserting direction. This produces a structurally simple embodiment while minimizing the parts required.

In that case, it is favorable if the container device is fixable to the cleaning head by way of the cover device, at least in relation to the direction of removing or inserting the container device at the cleaning head.

In one embodiment, the fixing device for the cover device has at least one element that is applied to a mating element of the cleaning head that is not part of the container device, wherein the at least one element and the mating element are movable relative to one another. As a result, it is possible in a simple manner, and in particular by user access, to achieve fixing by the engagement of the at least one element with its mating element, and to release the fixing in a simple manner.

It may be provided for the at least one cleaning roller unit to include a multi-part cleaning roller. It is thus possible for example to produce a center drive or center link such that edges are readily accessible for cleaning.

In one embodiment, during the cleaning operation, the surface cleaning machine is supported on the surface to be cleaned solely by way of the at least one cleaning roller unit, and in particular a single cleaning roller unit. This produces simple operability. In particular, a rotary drive of the cleaning roller unit may be used for forward drive of the surface cleaning machine.

In an alternative embodiment, a first cleaning roller unit and a second cleaning roller unit are provided, between which the dirty fluid reservoir device is arranged.

In particular, the first cleaning roller unit and the second cleaning roller unit rotate in opposite directions. This produces an effective cleaning operation, since in particular the two cleaning roller units are simultaneously applicable to a large surface.

In particular, the surface cleaning machine takes the form of a manually guided or hand-held machine.

In that case, there is provided in particular a (holding) rod device on which the cleaning head is seated. This produces simple operability.

It is also possible for the cleaning head to be self-propelling and self-steering, and in particular to take the form of a type of cleaning robot.

The description below of preferred embodiments serves, in conjunction with the drawings, to explain the invention in more detail.

DETAILED DESCRIPTION OF THE INVENTION

Figure 1:
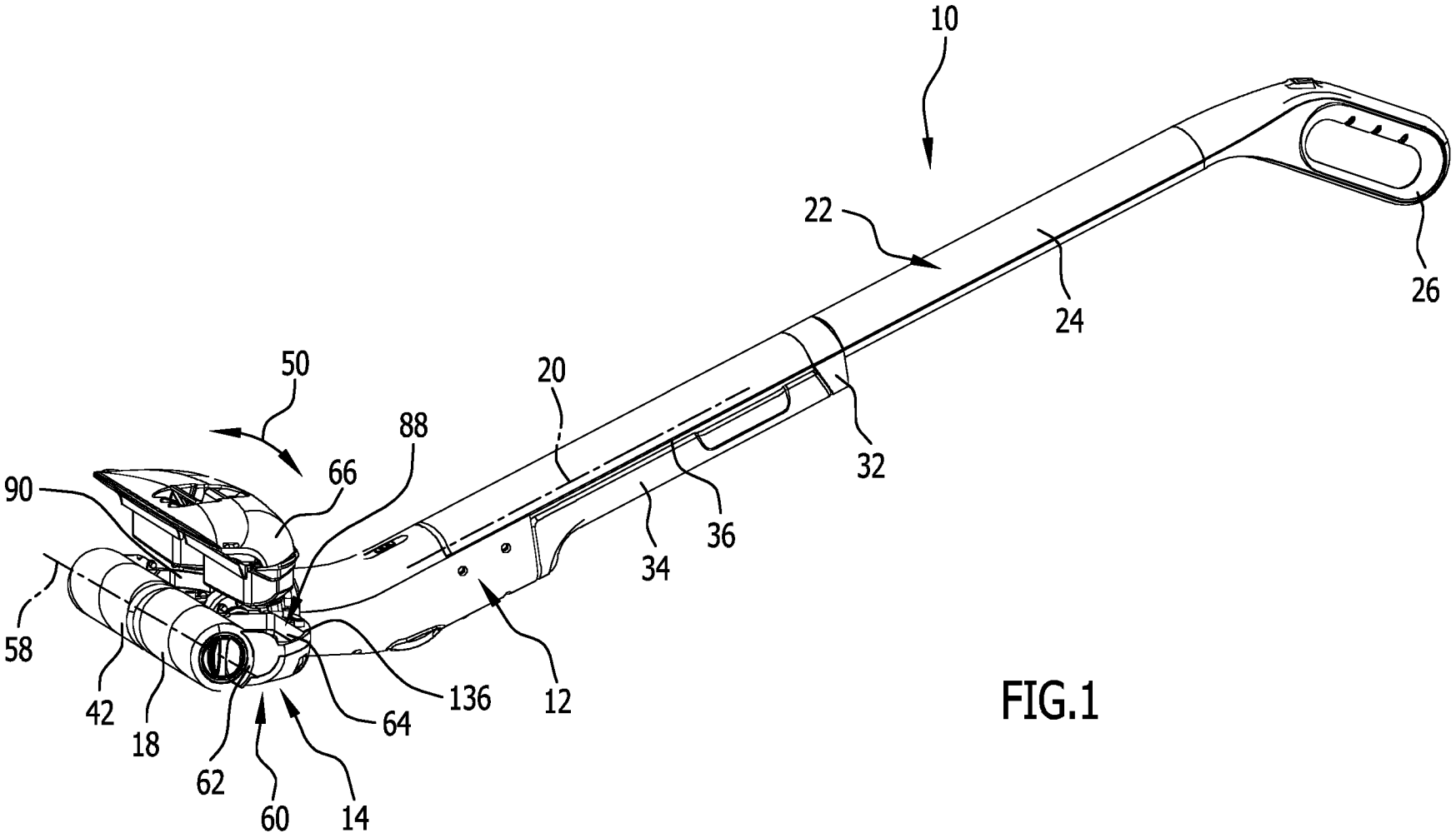
FIG. 1 is a perspective illustration of an exemplary embodiment of a surface cleaning machine according to the invention, with a dirty fluid reservoir device separated.

An exemplary embodiment of a surface cleaning machine according to the invention, which is shown in FIG. 1 and in partial illustration in FIGS. 2 to 8 and is designated 10, takes the form in particular of a hand-held, manually guided floor cleaning machine for hard floors.

The surface cleaning machine 10 includes a device body 12 and a cleaning head 14. The cleaning head 14 is arranged on the device body 12.

During a cleaning procedure on a surface 16 to be cleaned, the surface cleaning machine 10 is supported, on the surface 16 to be cleaned, by way of a cleaning roller unit 18 and in particular a single cleaning roller unit 18. The cleaning roller unit 18 has a single axis of rotation 58 (see below). The cleaning roller unit 18 is a cleaning roller which may be in one part or multiple parts. In the embodiment described below, the cleaning roller unit 18 is or includes a two-part cleaning roller.

The device body 12 has a longitudinal axis 20. The surface cleaning machine 10 is held or guided by an elongate handle. For this purpose, a holding rod device 22 is seated on the device body 12.

In one exemplary embodiment, the holding rod device 22 includes a (in particular, just one) holding rod 24 of which a longitudinal extent is parallel to the longitudinal axis 20. In an upper region of the holding rod device 22 there is arranged a handle 26, in particular a stirrup-shaped handle. A person operating the surface cleaning machine 10 can hold it with one hand by this handle 26 and guide it on the surface 16 to be cleaned (with the cleaning roller unit 18 supported).

The holding rod device 22 may take a form such that it is height-adjustable or of fixed length in relation to the length of the longitudinal axis 20.

The surface cleaning machine 10 is dimensioned such that when the cleaning roller unit 18 is supported on the surface 16 to be cleaned, a person operating it can comfortably perform a cleaning procedure on the surface 16 to be cleaned with a holding arm bent. In particular, a length of the surface cleaning machine 10 along the longitudinal axis 20 between the cleaning roller unit 18 and the stirrup-shaped handle 26 is in a range of between 60 cm and 130 cm.

One or more operating elements are in particular arranged on the handle 26. For example, a switch is provided by way of which the surface cleaning machine 10 is switchable on or off for a cleaning operation. Operation of a drive motor 28 (FIG. 2) for rotary operation of the cleaning roller unit 18 is switchable by this switch. Further, a switch for actuating a valve device 38 (see below) may be provided.

The device body 12 includes a housing 30 in which components of the surface cleaning machine 10 are arranged such that they are protected.

A holder 32 is arranged on the housing 30. Separably arranged on the holder 32 is a reservoir device 34 for cleaning liquid (in particular water, with or without an additional detergent).

Arranged on the housing 30, on the holder 32, is a reservoir receptacle 36 for the reservoir device 34. A corresponding outlet of the reservoir device 34 is connectable to the reservoir receptacle 36.

A valve device 38 is positioned in the housing 30, downstream of the reservoir receptacle 36.

One or more fluid conduits 40 lead from the valve device 38 to the cleaning head 14.

The valve device 38 has a shut-off valve through which the supply of cleaning liquid from the reservoir device 34 to the cleaning head 14 is configured to be switchably shut off. A filtering device 39 for cleaning liquid may be associated with the valve device 38. The filtering device 39 is in particular arranged upstream of the shut-off valve and between the valve device 38 and the reservoir receptacle 36.

When the shut-off valve is open, cleaning liquid can flow out of the reservoir device 34 and through the fluid conduit or conduits 40 to the cleaning head 14, and be applied to the surface 16 to be cleaned.

For this purpose, one or more outlet orifices 140 for cleaning liquid are provided on the cleaning head 14 (see below).

The outlet orifice or orifices 140 are arranged such that cleaning liquid is applied to the cleaning roller unit 18 and in particular a facing 42 of the cleaning roller unit 18. When cleaning liquid is applied to the cleaning roller unit 18, the surface 16 to be cleaned has cleaning liquid applied to it indirectly.

The facing 42 is made in particular of a textile material.

Associated with the valve device 38 is a switch that allows the user to adjust whether the shut-off valve of the valve device 38 is shut off (that is to say that incoming flow of cleaning liquid to the cleaning head 14 is shut off) or open (that is to say that incoming flow for cleaning liquid from the reservoir device 34 to the cleaning head 14 is released).

This switch may be arranged on the housing 30. In principle, it is also possible for the switch to be arranged on the handle 26.

In one exemplary embodiment, a battery device 44 is arranged in or on the housing 30, for supplying electrical energy to the drive motor 28. The battery device 44 is rechargeable. This allows the surface cleaning machine 10 to be operated independently of a mains supply.

However, in principle it is also possible for the surface cleaning machine 10 to be operated using mains electricity. In that case, a corresponding connection device for mains electricity is arranged on the surface cleaning machine 10.

In this case, the battery device 44 may be separable from the device body 12 so that recharging can be performed at an appropriate charging device.

It may also be provided for a corresponding charging device to be integrated into the device body 12 and for recharging to be performable without removing the battery device 44 from the device body 12. Corresponding connection sockets are arranged for example on the holding rod 24.

The drive motor 28 is an electric motor. It has a motor spindle 46. The motor spindle 46 is coaxial with an axis of rotation of the drive motor 28.

The drive motor 28 is seated on the device body 12 between the cleaning head 14 and the housing 30.

In one exemplary embodiment, the motor spindle 46 is oriented at an angle to the longitudinal axis 20 of the device body 12 (and the holding rod 24). The angle formed by the motor spindle 46 and the longitudinal axis 20 is for example in the range between 130° and 170°.

In one exemplary embodiment, the cleaning head 14 is pivotal in relation to the device body 12 about a pivot axis 48. This pivotal configuration is indicated in FIG. 1 by the double-headed arrow bearing the reference numeral 50.

In particular, the pivot axis 48 is coaxial with the motor spindle 46.

In one embodiment, the drive motor 28 is arranged on an inner sleeve 52. This inner sleeve 52 preferably forms an enclosure for the drive motor 28.

An outer sleeve 54 is permanently seated on the device body 12. The inner sleeve 52 is seated in the outer sleeve 54. Here, the inner sleeve 52 is pivotal about the pivot axis 48 in relation to the outer sleeve 54, with the inner sleeve 52 mounted pivotally in the outer sleeve 54. The inner sleeve 52 and the outer sleeve 54 form a pivot bearing 56 for the pivotal configuration of the cleaning head 14 in relation to the device body 12. In this case, the drive motor 28 is pivotal about the pivot axis 48 in relation to the device body 12. Corresponding supply lines from the battery device 44 to the drive motor 28 are arranged and take a form such that they enable the pivotal configuration. Accordingly, the fluid conduit or conduits 40 take a form such that they allow this pivotal configuration.

Figure 2:
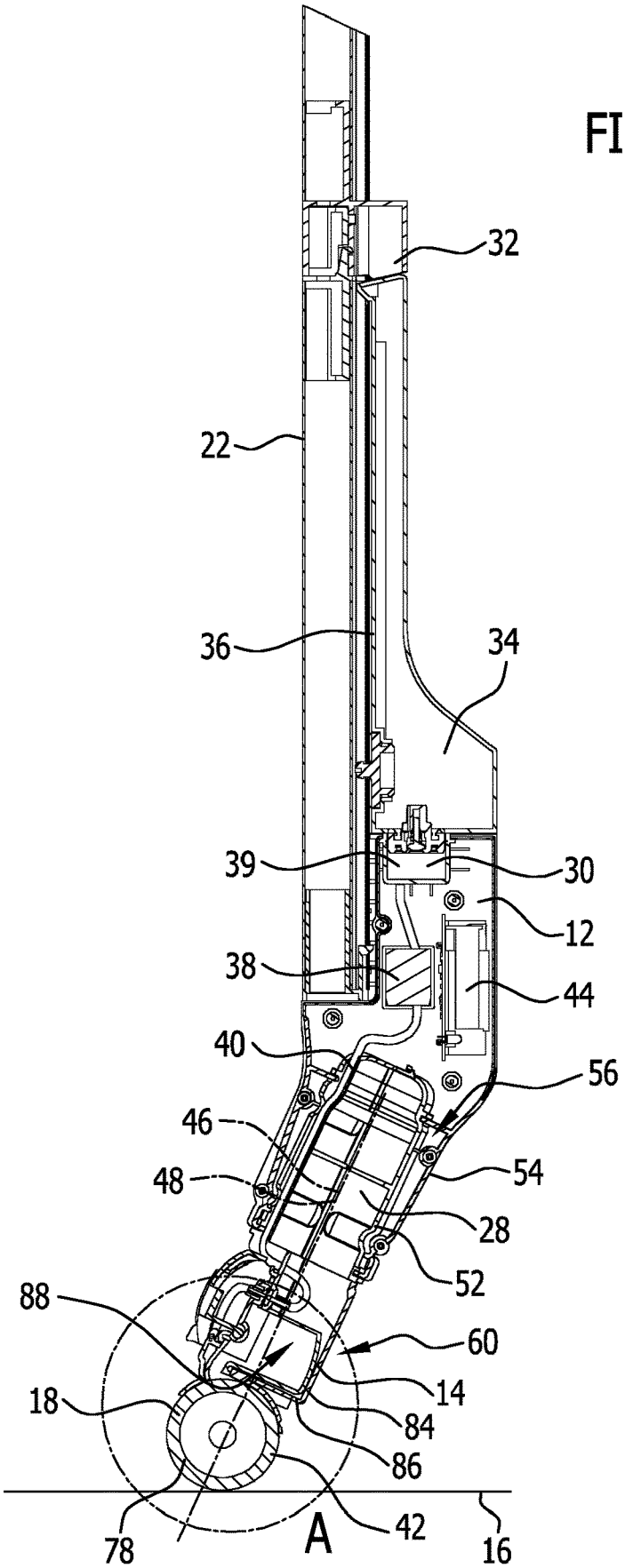
FIG. 2 shows a partial lateral sectional view of the surface cleaning machine in FIG. 1, with the dirty fluid reservoir device fixed.

The pivot bearing 56 has a home position that is defined for example in that a (the only) axis of rotation 58 of the cleaning roller unit 18 is oriented perpendicular to the plane of the drawing in FIG. 2. Pivoting about the pivot axis 58 relative to this home position takes the form of an angular position of the axis of rotation 58 in relation to the plane of the drawing in FIG. 2 when the cleaning head 14 is freely pivotal (that is, is not supported).

The pivot bearing 56 is in particular set up such that a particular force needs to be exerted, by comparison with a normal cleaning operation, in order to bring about pivoting of the cleaning head 14 out of its home position.

The pivotal configuration of the cleaning head 14 about the pivot axis 48 enables improved ways of cleaning, even in places that are relatively difficult to access, in that the device body 12, with the holding rod device 22, may be "repositioned" to a certain extent in relation to the surface 16 to be cleaned.

The cleaning head 14 has a cleaning roller holder 60 on which the cleaning roller unit 18 is seated rotatably about the axis of rotation 58. The cleaning roller holder 60 is connected to the inner sleeve 52 such that it cannot rotate in relation thereto.

Figure 3:
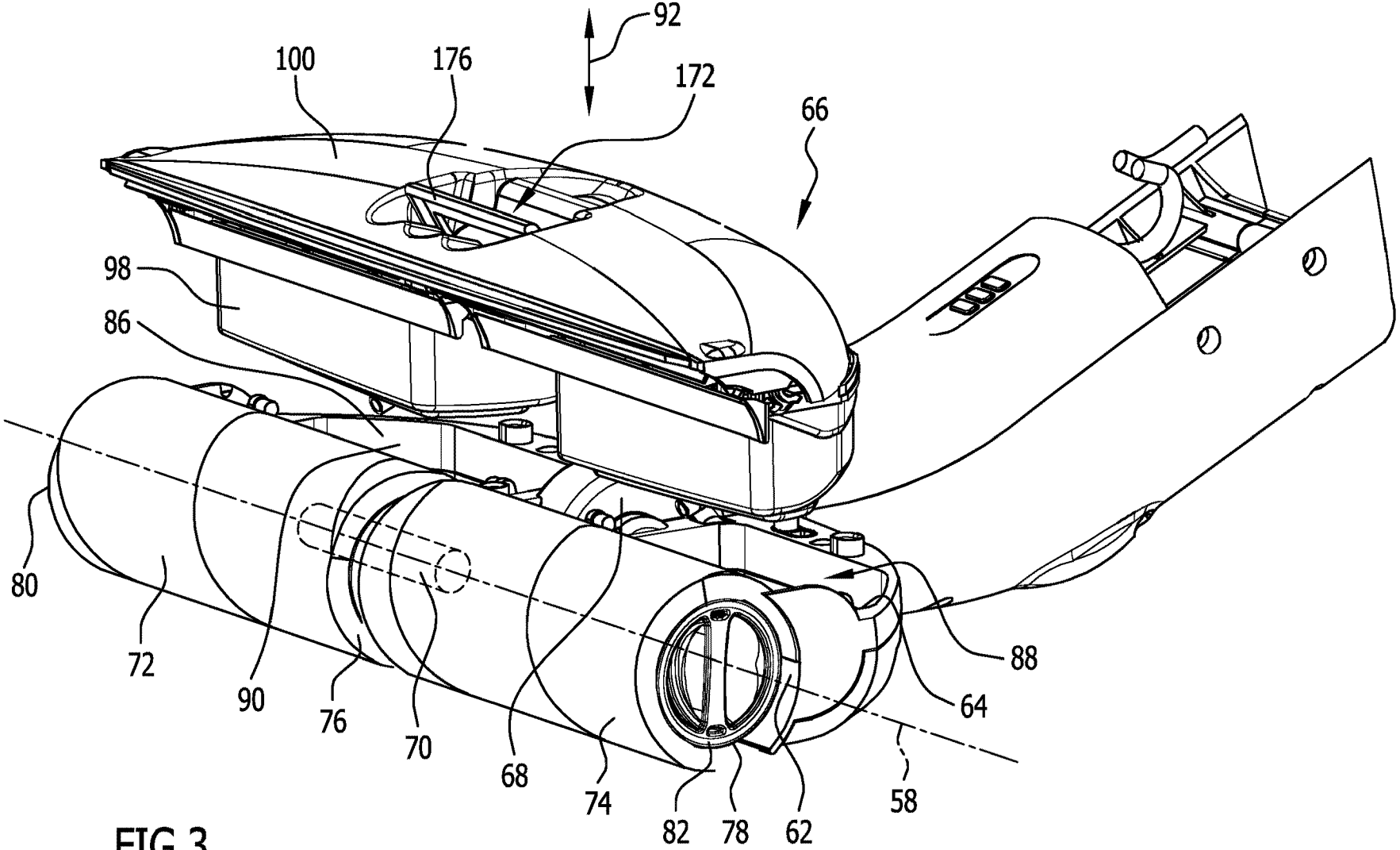
FIG. 3 is an enlarged illustration of a cleaning head with dirty fluid reservoir device, corresponding to the region A in FIG. 2, with the dirty fluid reservoir device separated.
Figure 4:
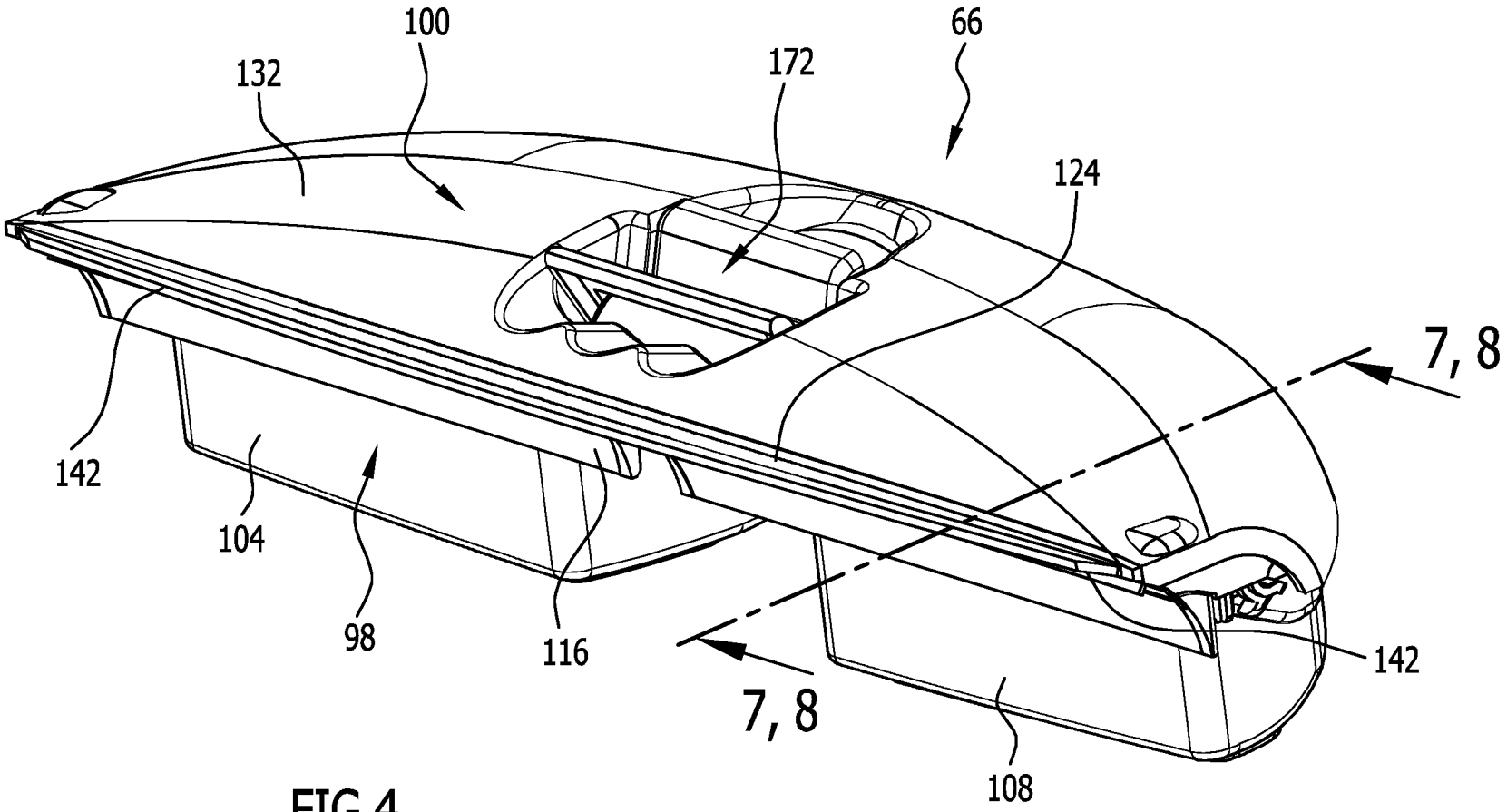
FIG. 4 shows a perspective view of the dirty fluid reservoir device from FIG. 3.
Figure 5:
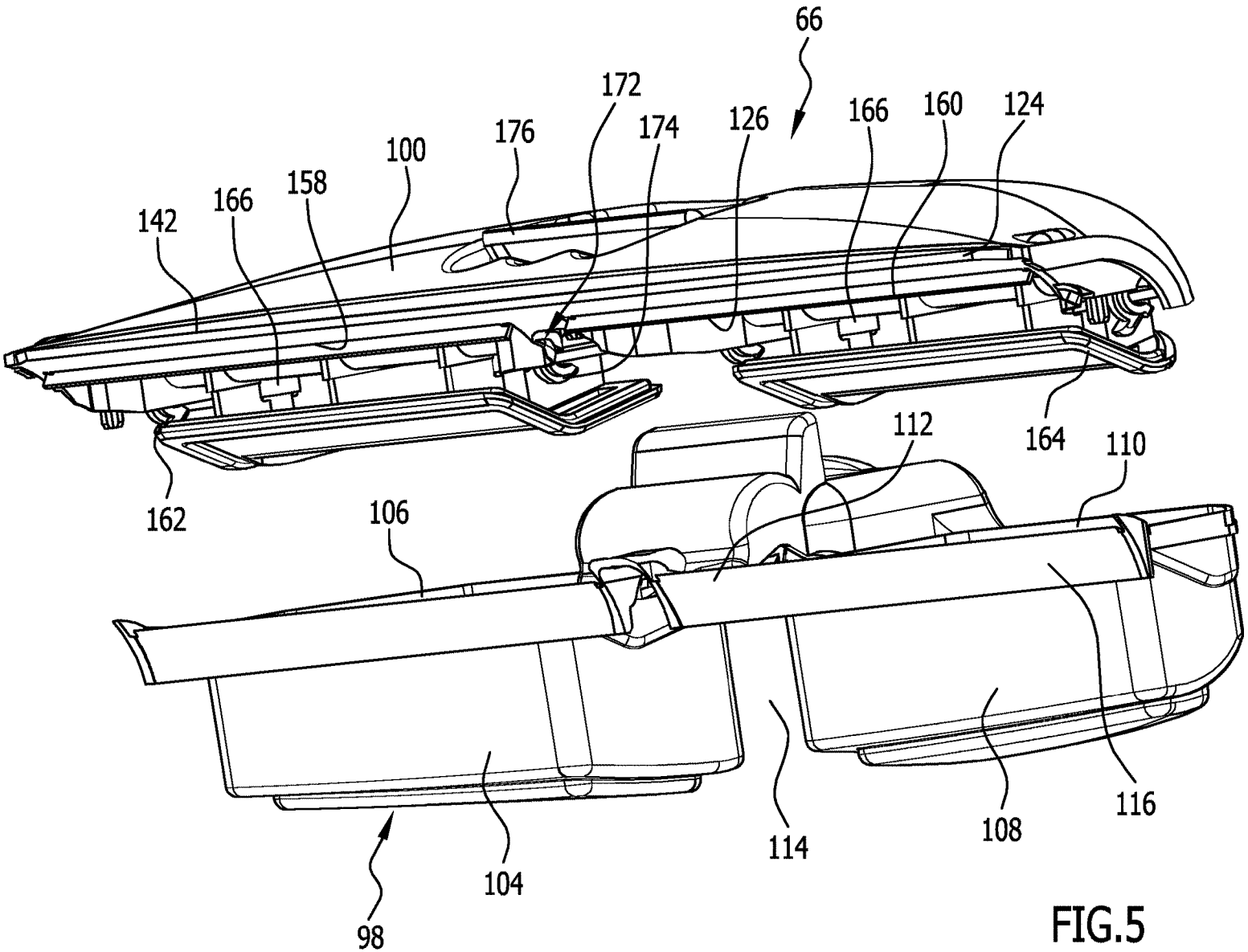
FIG. 5 is another perspective illustration of the dirty fluid reservoir device in FIG. 4, with the cover device separated.
Figure 6:
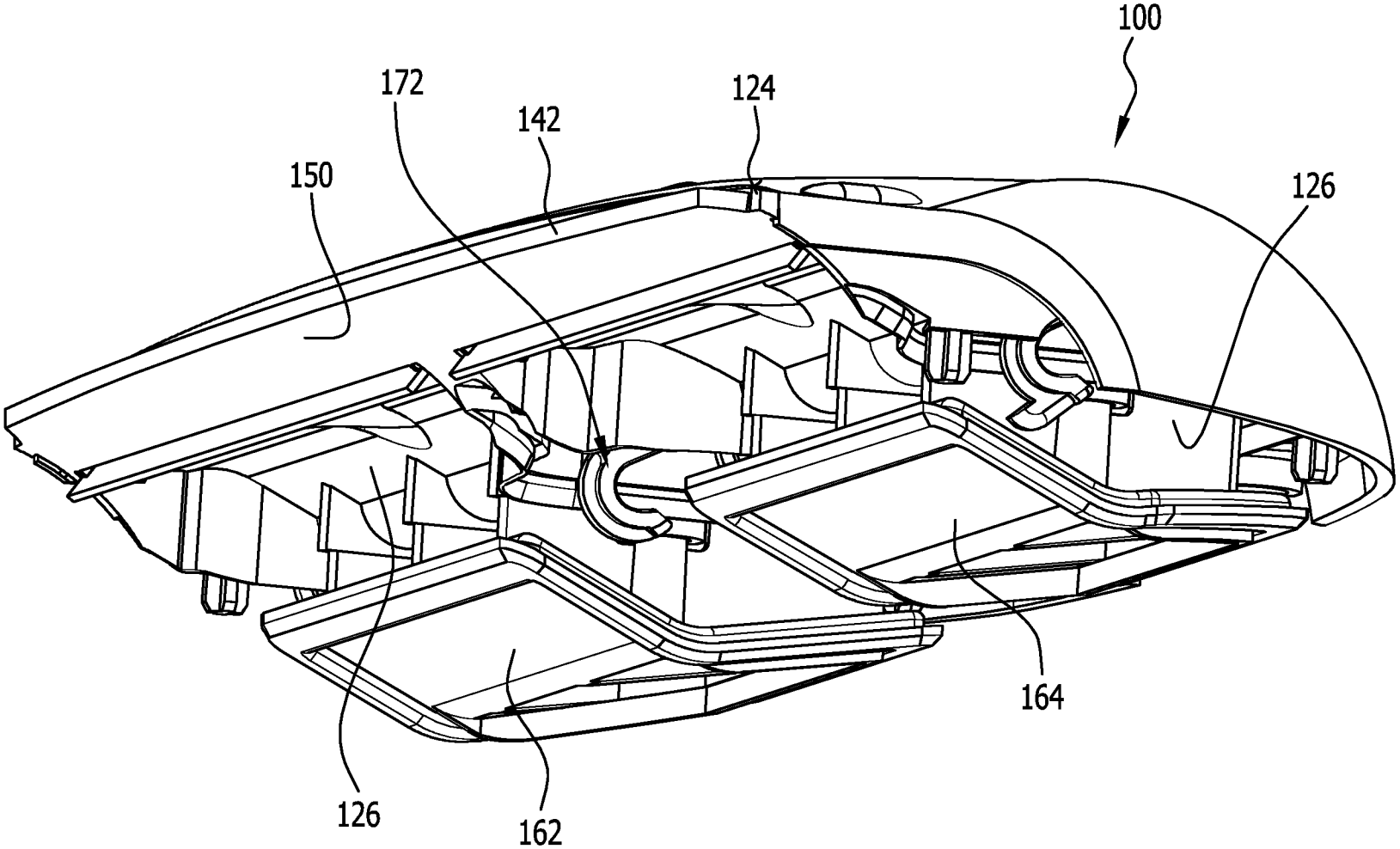
FIG. 6 shows a perspective view of the cover device in FIG. 5.

The cleaning roller holder 60 has a holding region 62 for the cleaning roller unit 18, and a receiving region 64 for a dirty fluid reservoir device 66 (cf. for example FIG. 3).

The receiving region 64 is positioned between the holding region 62 and the inner sleeve 52. The inner sleeve 52 is in particular permanently connected to an outer side of the receiving region 64.

The cleaning roller unit 18 is coupled to the drive motor 28 in a manner applying torque, by way of a gear device 68.

The gear device 68 connects a motor shaft of the drive motor 28 (which rotates about the motor spindle 46) to a shaft 70 for the cleaning roller unit 18, in a manner applying torque.

In one exemplary embodiment, the gear device 68 includes a step-down gear. This serves to reduce a speed of rotation in relation to the speed of rotation of the motor spindle. For example, a standard electric motor has speeds of rotation in the order of magnitude of 7 000 revolutions per minute. The step-down gear provides for a reduction in speed to for example about 400 revolutions per minute.

The step-down gear may be arranged in the inner sleeve 52, or outside the inner sleeve 52 on the cleaning roller holder 60.

The step-down gear takes the form for example of a planetary gear.

Further, the gear device 68 has an angular gear that provides for a redirection of torque in order to bring about drive of the cleaning roller unit 18 with the axis of rotation 58 transverse (and in particular perpendicular) to the motor spindle 46. The angular gear is in particular arranged downstream of the step-down gear.

In one exemplary embodiment, the angular gear has one or more gear wheels that are coupled to a corresponding shaft of the step-down gear such that they cannot rotate in relation thereto. These act on a cone gear wheel for the purpose of changing the angle.

In an alternative embodiment, it may be provided for the angular gear transmission to provide for step-down gearing.

In one exemplary embodiment, the gear device 68 further includes a belt that is coupled to the angular gear in a manner applying torque, and acts on the shaft 70. The belt bridges the spacing between the shaft 70 and the angular gear, and provides for step-down gearing.

In one exemplary embodiment, the cleaning roller unit 18 is formed in two parts, with a first part 72 and a second part 74. The first part 72 is seated on a first side of the shaft 70 such that it cannot rotate in relation thereto, and the second part 74 is seated on a second side of the shaft 70, the opposite side to the first side of the shaft 70, such that it cannot rotate in relation to the second side of the shaft 70.

In an intermediate region 76 between the first part 72 and the second part 74, the gear device 68 is guided on the shaft 70 and coupled to the shaft 70.

The first part 72 and the second part 74 have the same axis of rotation 58.

The cleaning roller unit 18, or the first part 72 and the second part 74 of the cleaning roller unit 18, (each) have a sleeve 78 (cf. for example FIG. 3) that takes a cylindrical form. The facing 42 is arranged on the sleeve 78. The cleaning roller unit 18, or the first part 72 and the second part 74, is fixed to the shaft 70 by way of the sleeve 78.

The cleaning roller unit 18 is arranged on the cleaning head 14 such that the axis of rotation 58 is oriented perpendicular to the longitudinal axis 20.

Along the axis of rotation 58, between a first end face 80 (which is formed on the first part 72) and a second end face 82 (which is formed on the second part 74), the cleaning roller unit 18 has a length that is considerably greater than a corresponding width of the device body 12 perpendicular to the longitudinal axis 20. In particular, a length of the cleaning roller unit 18 between the first end face 80 and the second end face 82 is at least 20 cm and preferably at least 25 cm and for example approximately 30 cm.

The receiving region 64 has a base 84 (cf. for example FIG. 2). A receiving region wall 86 is arranged on the base 84, oriented transversely thereto. The receiving region wall 86 and the base 84 of the receiving region 64 define a receiving chamber 88 for the dirty fluid reservoir device 66.

Opposite the base 84, the receiving chamber 88 is open. The dirty fluid reservoir device 66 is removable from or insertable into the receiving chamber 88 through a corresponding side 90. A removing direction or inserting direction 92 (cf. FIG. 3) is substantially perpendicular to the base 84 (and perpendicular to the axis of rotation 58).

The dirty fluid reservoir device 66 includes a container device 98 and a cover device 100 (in particular FIGS. 3 to 8). The cover device 100 closes the container device 98, in particular upwardly, in order to prevent dirty fluid 102 that is collected in the container device (FIG. 7) from leaking or slopping out.

The cover device 100 is arranged detachably or movably on the container device 98 such that by opening the cover device 100 the container device 98 is configured to be emptied of collected dirty fluid 102, or the container device 98 is accessible for cleaning thereof.

In the exemplary embodiment shown (FIGS. 3 to 8) the cover device 100 is detachable as a whole from the container device 98.

In the embodiment shown, the container device 98 includes a first receiving chamber 104 having a first receiving chamber space 106 for dirty fluid, and a second receiving chamber 108 having a second receiving chamber space 110 for dirty fluid. The first receiving chamber 104 is associated with the first part 72 of the cleaning roller unit 18, and the second receiving chamber 108 is associated with the second part 74 of the cleaning roller unit 18. The first receiving chamber 104 and the second receiving chamber 108 are connected to one another by way of a holder 112.

Between the first receiving chamber 104 and the second receiving chamber 108 there is formed an intermediate space 114 (duct 114). This intermediate space 114 is upwardly delimited by the holder 112.

When the dirty fluid reservoir device 66, with the container device 98, is properly inserted at the receiving region 64 of the cleaning head 14, the intermediate region 76 lies in the intermediate space 114.

The container device 98 includes a lug 116. This is arranged in particular on the holder 112. When the dirty fluid reservoir device 66 is inserted at the receiving region 64 of the cleaning head, the lug points to the holding region 62 for the cleaning roller unit 18. Accordingly, the lug 116 has a cylindrical surface 118 towards this holding region 62.

Further, the lug 116 has a bearing surface 120 for the cover device 100.

It is provided in particular for the container device 98 to be made as a unitary part.

As mentioned above, the cover device 100 serves to close the container device 98. Further functional components are arranged thereon.

It is provided for cleaning liquid (from the reservoir device 34 for cleaning liquid) to be provided to the cleaning roller unit 18 by way of the cover device 100.

For this purpose, a duct device 122 is formed on the cover device 100. The duct device 122 can be connected or, in particular when the dirty fluid reservoir device 66 is arranged on the cleaning head 14, is connected fluidically to the reservoir device 34. Arranged on the cover device 100 is an orifice device 124 that is fluidically connected to the duct device 122 and through which cleaning liquid can be directly applied to the cleaning roller unit 18. The orifice device 124 forms the outlet orifice or orifices.

The cover device 100 in particular takes the form of a single element that is provided for covering both the first receiving chamber 104 and the second receiving chamber 108. For this purpose, the cover device 100 has a set-down region 126 by means of which it is configured to be set down on the container device 98 and in particular to be set down in a sub-region, on the lug 116. The set-down region 126 also upwardly closes the receiving chambers 104 and 108. In one exemplary embodiment, it is provided (cf. in particular FIG. 7) for a flange 128 to be positioned on a side of the container device 98 remote from the side on which the lug 116 is seated. The set-down region 126 has a further sub-region 130 by means of which it is configured to be positioned on the flange 128.

In principle, it may be provided for there to be arranged on the set-down region 126 a sealing device that provides for a liquid-tight connection between the cover device 100 and the container device 98 having the receiving chambers 104, 108 when the cover device 100 is properly positioned on the container device 98.

Further, the cover device 100 has an upper side 132. The duct device 122 is positioned between the upper side 132 and the set-down region 126, on or in the cover device 100.

The duct device 122 has a connector 134 (shown only schematically in FIG. 7) for fluidic connection with the reservoir device 34.

Here, it may be provided for a mating connector 136 for the connector 134 to be arranged on the cleaning head 14 and thus on the receiving region 64. In that case, it is in particular provided, when the container device 98 is inserted at the cleaning head 14 and the cover device 100 is properly positioned, for a fluidic coupling between the connector 134 and the mating connector 136 to be obtained automatically, in order to enable cleaning liquid to be applied to the cleaning roller unit 18 by way of the duct device 122 and the orifice device 124 of the cover device 100.

Here, in principle it is possible for a plurality of connectors 134 and correspondingly a plurality of mating connectors 136 to be provided, or for only one connector 134 and only one mating connector 136 to be provided.

Further, in principle it is also possible for a fluidic connection to have to be made manually between the connector 134 and the mating connector 136, for example by fluidically connecting a liquid conduit to the connector 134 and the mating connector 136.

The duct device 122 of the cover device 100 takes a form such that it makes a fluidic connection between the connector or connectors 134 and the orifice device 124.

The duct device 122 includes one or more ducts between the connector or connectors 134 and the orifice device 124. A duct or ducts of this kind may for example be made by corresponding hose connections or similar.

In one embodiment, the duct or ducts 138 are provided by regions in the cover device 100 that contain no material and through which cleaning liquid can then flow.

As mentioned above, the orifice device 124 is arranged and takes a form such that cleaning liquid is substantially applicable to the cleaning roller unit 18 over its entire length and in particular to the facing 42 of the cleaning roller unit 18 over its entire facing length.

In particular, the orifice device 124 includes one or more orifice slots 140. An orifice slot 140 is arranged on the cover device 100, towards the holding region 62. It is oriented with its longitudinal axis parallel to the axis of rotation 58 of the cleaning roller unit 18.

The orifice slot or slots 140 are arranged such that cleaning liquid is substantially directly applicable to the facing 42 over its entire facing length, out of the orifice device 124.

It is provided in particular for cleaning liquid to be suppliable directly out of the duct device 122 to at least 80% and preferably at least 90% of the length of the sleeve, through the orifice slot or slots 140. In a preferred embodiment, cleaning liquid is suppliable to 100% of the length of the sleeve, through the orifice slot or slots 140.

In particular, the orifice slot 140 has a first region associated with the first part 72, and a second region associated with the second part 74 of the cleaning roller unit 18. A corresponding length of the first region substantially corresponds to a length (parallel to the axis of rotation 58) of the first part 72. A corresponding length of the second region corresponds to the corresponding length of the second part 74 of the cleaning roller unit 18.

It is possible for the first region and the second region to be separated by the intermediate region 76.

In the exemplary embodiment shown, the orifice slot 140 is continuous, with the result that the first region merges directly into the second region.

The duct device 122 on the cover device 100 correspondingly takes a form such that the orifice slot 140 and hence the orifice device 124 are supplied with cleaning liquid substantially over their entire length in order correspondingly to be able to supply the facing 42 of the cleaning roller unit 18 with cleaning liquid substantially over its entire facing length.

Arranged on the cover device 100 is a scraping guide device 142. The scraping guide device 142 serves to remove dirty fluid from the cleaning roller unit 18 (out of the facing 42 thereof) and guide it into the container device 98.

In principle, the scraping guide device may also be arranged on the container device 98.

In the exemplary embodiment shown, it is arranged on the cover device 100. Here, it is positioned in the region of the orifice device 124. The scraping guide device 142 forms a wall 144 (cf. FIGS. 7 and 8) that delimits the duct device 122 in the cover device 100. Further, the scraping guide device 142 then forms a wall at the orifice device 124—this being a wall delimiting the orifice slot 140.

This said wall is a separating wall 146 between the orifice device 124 for cleaning liquid and an inlet orifice 148 (cf. in particular FIG. 7) for dirty fluid to enter the dirty fluid reservoir device 66.

The scraping guide device has a first side 150 facing the inlet orifice 148. This first side 150 is used to form a guide surface for dirty fluid. It acts as a diverting surface and/or baffle for dirty fluid.

Further, the scraping guide device 142 has a second side 152, on the opposite side to the first side 150. This second side 152 forms a guide surface for cleaning fluid in the duct device 122 as it flows to the orifice device 124.

The scraping guide device 142 has a region 154 that projects into the holding region 62. When the dirty fluid reservoir device 66 is properly positioned on the cleaning head 14, the scraping guide device can penetrate into the facing 42 of the cleaning roller unit 18 by way of this region 154, specifically in order to remove dirty fluid.

At the same time, this region 154 can also serve for the targeted supply of cleaning liquid to the cleaning roller unit 18, using its side at the orifice slot 140.

The scraping guide device 142 basically has a first region associated with the first part 72 of the cleaning roller unit 18, and a second region associated with the second part 74 of the cleaning roller unit 18.

In one exemplary embodiment, the first region and the second region are connected to one another. In this arrangement, the scraping guide device 142 is continuous, in particular if the orifice slot 140 is formed to be continuous. It is also possible for the scraping guide device to be in multiple parts and in particular in two parts.

It is in principle possible for the inlet orifice 148 to be formed only on the cover device 100, only on the container device 98, or to be formed such that when the cover device 100 is positioned on the container device 98 an inlet orifice 148 is created.

In the exemplary embodiment shown in FIGS. 4 to 8, the case is such that the inlet orifice 148 is formed between the cover device 100, delimited by the first side 150 of the scraping guide device 142, and the container device 98, delimited by the lug 116. As a result, when the cover device 100 is positioned on the container device 98, the inlet orifice 148 lies between the lug 116 and the first side 150 of the scraping guide device 142.

There is provided a duct device 156 that is fluidically connected to the inlet orifice 148 and the receiving chamber spaces 106 and 110.

In particular, the duct device 156 includes a first duct 158 associated with the first receiving chamber 104, and a second duct 160 associated with the second receiving chamber 108. The first duct 158 and the second duct 160 are in particular fluidically separated from one another. Dirty fluid that enters through the inlet orifice 148 can be supplied to the first receiving chamber space 106 through the first duct 158. Accordingly, dirty fluid that enters through the inlet orifice 148 can be supplied to the second receiving chamber space 110 through the second duct 160.

In particular, when the cover device 100 is set on the container device 98, the duct device 156 is upwardly delimited by the set-down region 126 of the cover device.

In one embodiment, retaining elements 162 (first retaining element) and 164 (second retaining element) are associated with the dirty fluid reservoir device 66. Here, the first retaining element 162 is associated with the first receiving chamber 104 and the second retaining element 164 is associated with the second receiving chamber 108.

The retaining elements 162, 164 serve to penetrate into the corresponding receiving chamber space 106 and 110. They form a type of protection against slopping, or they serve to prevent dirty fluid from escaping from the dirty fluid reservoir device 66 when the surface cleaning machine 10 is in inclined dispositions.

In the exemplary embodiment shown in FIGS. 4 to 8, both the first retaining element 162 and the second retaining element 164 are arranged on the cover device 100. In this case, they are positioned on the cover device 100, in each case spaced from the set-down region 126 by way of pillars 166. The first retaining element 162 and the second retaining element 164 are in this case spaced apart, specifically in order to enable them to penetrate into the respective receiving chamber 104 and 108.

The first duct 158 is formed between the first retaining element 162 and the set-down region 126. The second duct 160 is formed between the second retaining element 164 and the set-down region 126.

The first retaining element 162 and the second retaining element 164 each have at least one opening 168 (cf. FIG. 7) that is fluidically connected to the duct device 156, with the result that dirty fluid flowing in the duct device 156 can flow through the opening 168 and into the respective receiving chamber space 106 or 110.

In particular, the respective retaining element 162 and 164 takes a form such that, with the exception of the opening or openings 168, the respective receiving chamber space 106 and 110 is otherwise upwardly completely covered by the respective first retaining element 162 and the second retaining element 164 respectively.

In one embodiment, the duct device 156 takes a form such that the respective first duct 158 or second duct 160 is oriented away from the inlet orifice 148, at an acute angle 170 to the axis of rotation 58 (when the container device 98 is inserted at the cleaning head 14).

This forms a sloping duct region in order to support the inflow of dirty fluid at the opening 168.

In particular, the opening 168 (or accordingly, where there are a plurality of openings, a plurality of openings) lies, at least in a sub-region, at a lower gravitational potential than the inlet orifice 148 when the dirty fluid reservoir device 66 is inserted at the cleaning head 14 and the surface cleaning machine is operated in a normal operation, set on a floor surface to be cleaned.

It is also possible for a retaining element 162 or 164 not to be provided with one or more openings but to take a form such that it does not completely cover an associated receiving chamber space 106 or 110 but leaves exposed an intermediate space that then acts as an opening 168.

The dirty fluid reservoir device 66 is separable from the cleaning head 14 as a whole. Here, in principle it is possible for the container device 98 for example to be directly fixable to the cleaning head 14 using a first fixing device. The cover device 100 can then be fixable to the container device 98 using a second fixing device. In this way, it is in particular possible for a container device 98 that is closed by the cover device 100 to be removable from the cleaning head 14 or insertable thereon as a whole (as a unit).

In one embodiment, it is provided for the cover device 100 to be directly fixable to the cleaning head 14 using a fixing device 172 and thus to be directly fixable to the receiving region 64.

Using a fixing device 172 of this kind makes it possible to make a direct connection between the cleaning head 14 and the cover device 100, as a result of which the dirty fluid reservoir device 66 is in turn fixable as a whole to the cleaning head 14.

In one exemplary embodiment, the cover device 100 includes one or more movable and in particular pivotal elements 174. An element or elements of this kind are formed in particular in a hook shape.

Arranged on the cover device 100 is a handle element 176 that is accessible from the outside. This handle element 176 can be used to actuate a pivotal movement of the hook-shaped element 174.

One or more mating elements 178 for the element 174 are seated on the receiving region 64 of the cleaning head 14. In one exemplary embodiment, a mating element 178 is formed in a cylinder shape, as a pin element. An element 174 may engage with a mating element 178. For example, a hook element may engage with a corresponding cylinder element (a holding pin).

In this way, the handle element 176 enables engagement to be released or made.

Using this fixing device 172, it is then possible to clamp the cover device 100 to the cleaning head 14.

The receiving region 64 of the cleaning head 14 in particular takes a form such that the dirty fluid reservoir device 66 is positionable therein and at the same time by a positive engagement movements transverse to the removing/inserting direction 92 are blocked. Then, the fixing device 172 uses the fixing of the cover device 100 to the receiving region 64 to ensure that movability in the removing/inserting direction 92 is blocked.

For the purpose of removing a dirty fluid reservoir device 66 from the cleaning head 14, by actuating the handle element 176 the element or elements 174 are disengaged from the respective associated mating elements 178. It is then possible to separate the cover device 100. The container device 98 can then be separated from the cleaning head 14 upwards, in the removing direction 92.

Accordingly, the container device 98 can be inserted into the receiving region 64 in the inserting direction 92. In that case, the cover device 100 is positioned with the set-down region 126 on the container device 98 (with the retaining elements 162, 164 penetrating into their respective receiving chamber spaces 106 and 110). By actuating the handle element 176, engagement is achieved between an element 174 and an associated mating element 178, and the dirty fluid reservoir device 66 as a whole is then fixed to the cleaning head 14, which may be mounted such that it is floating, and is clamped in the receiving region 64 by the cover device 100. In this case, the cover device 100 covers the container device 98.

The surface cleaning machine 10 according to the invention functions as follows:

During a cleaning operation, the dirty fluid reservoir device 66, with its container device 98 and its cover device 100, is inserted at the cleaning head 14 and fixed thereto by the fixing device 172.

Cleaning fluid from the reservoir device 34 is provided to the cleaning roller unit 18 by way of the duct device 122 and the orifice device 124.

During this, cleaning liquid is provided to the facing 42 over its entire length, by way of the orifice slot 140.

The scraping guide device 142 projects into the facing 42 and scrapes off dirty fluid. This is guided through the duct device 146 and into the receiving chambers 104, 108 of the container device (cf. FIG. 7).

The retaining elements 162 and 164 ensure that dirty fluid is retained in the respective receiving chamber spaces 106 and 110.

For the purpose of emptying the dirty fluid reservoir device 66, it is removed from the cleaning head 14.

In the first exemplary embodiment, for this purpose the fixing device 172 is detached by way of the handle element 176. The cover device 100 can then be separated. The container device 98 can then be removed upwards, in the removing direction 92.

The container device 98 can then be emptied and where necessary cleaned.

Arranged on the cover device 100 is the orifice device 124. Further, the duct device 122 is arranged thereon. This results in a simple, compact arrangement for the dirty fluid reservoir device 66. A receiving capacity for dirty fluid 102 in the dirty fluid reservoir device 66 can accordingly be made large.

Further, the scraping guide device 142 is arranged on the cover device 100. The scraping guide device 142 can thus be utilized to form the separating wall 146. This results in a structural and compact arrangement for the dirty fluid reservoir device 66.

Further, it may be provided for the retaining elements 162, 164 to be arranged on the cover device 100.

In particular, it is provided, by inserting the dirty fluid reservoir device 66 at the cleaning head 14, for a fluidic connection for cleaning liquid to be made with the reservoir device 34 automatically—that is to say that an automatic fluidic coupling is obtained between a connector 134 and its mating connector 136.

It is also possible, as described above, for the dirty fluid reservoir device 66 to be insertable on the cleaning head 14 or removable therefrom as a unit in which the cover device 100 is connected to the container device 98.

The orifice device 124 is arranged on the cover device 100. The scraping guide device 142 and the retaining elements 162, 164 are also arranged on the cover device 100. In principle, it is also possible for the scraping guide device and/or the retaining elements to be arranged on the container device 98.

In principle, it is also possible for the scraping guide device to be arranged on the cleaning head, outside the dirty fluid reservoir device.

Figure 7:
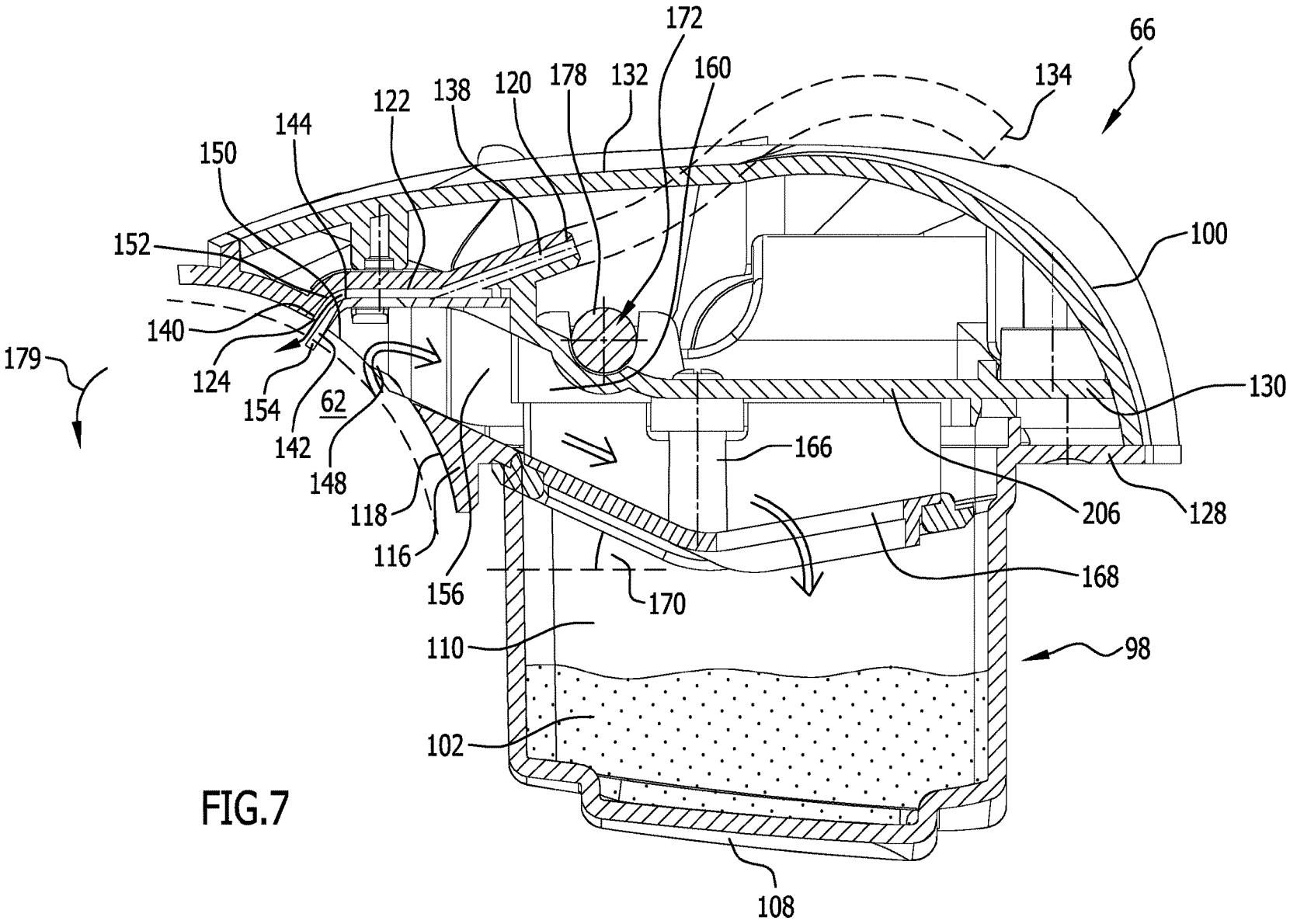
FIG. 7 shows a sectional view in a plane containing the line 7-7 in FIG. 4.
Figure 8:
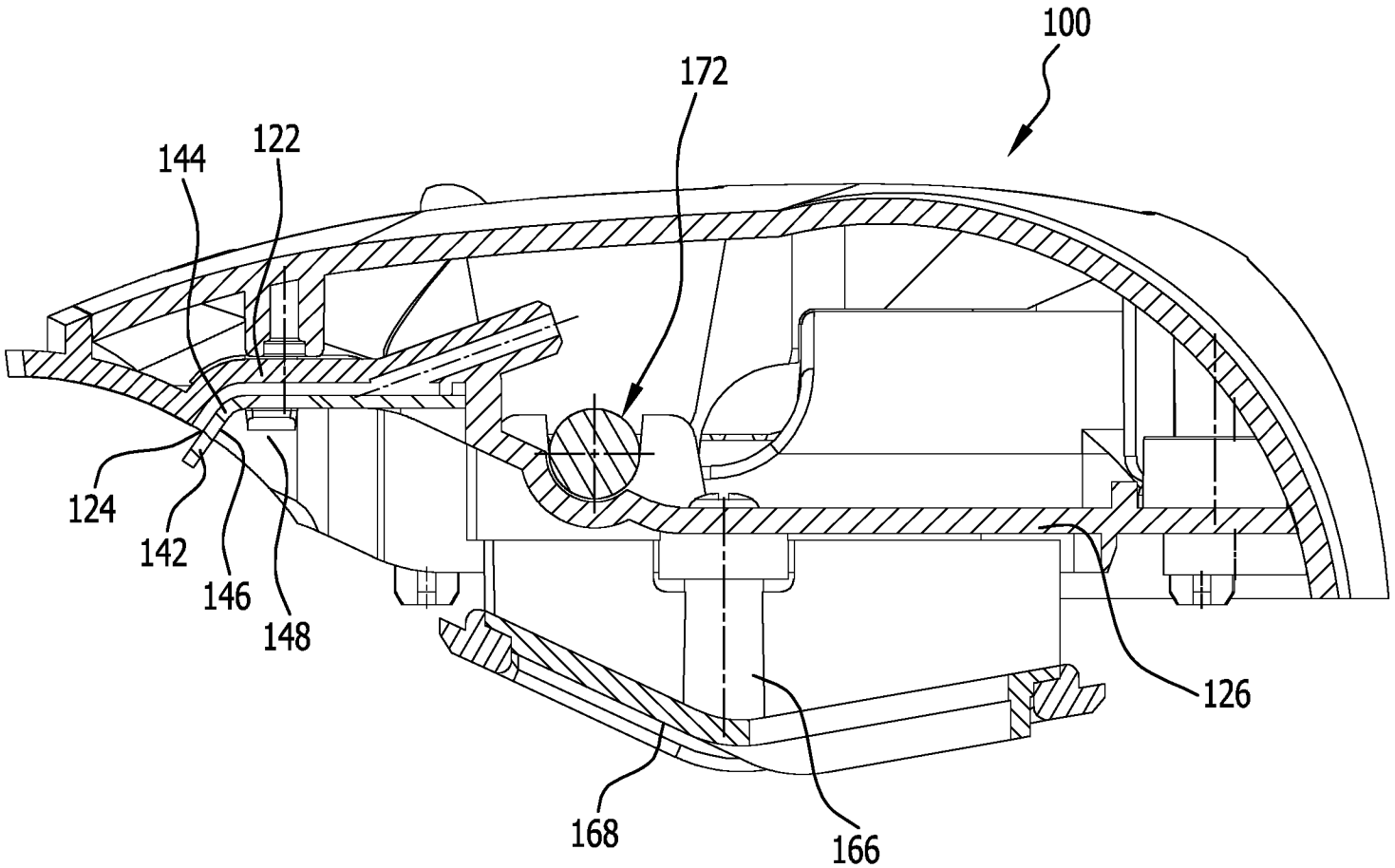
FIG. 8 shows the same sectional view as FIG. 7 of only the cover device, without the container device.

During a cleaning operation, the cleaning roller unit 18 is driven in rotation, preferably such that it has the effect of advancing the surface cleaning machine 10 as a whole over the surface 16 to be cleaned. FIG. 7 indicates a direction of rotation schematically by the reference numeral 179. A certain region of the cleaning roller unit 18 is first moistened at the orifice device 124 and rotates towards the surface 16 to be cleaned. There, dirt is loosened and taken up. The corresponding region then rotates towards the scraping guide device 142. There, dirty fluid is scraped off and introduced into the inlet orifice 148.

Figure 9:
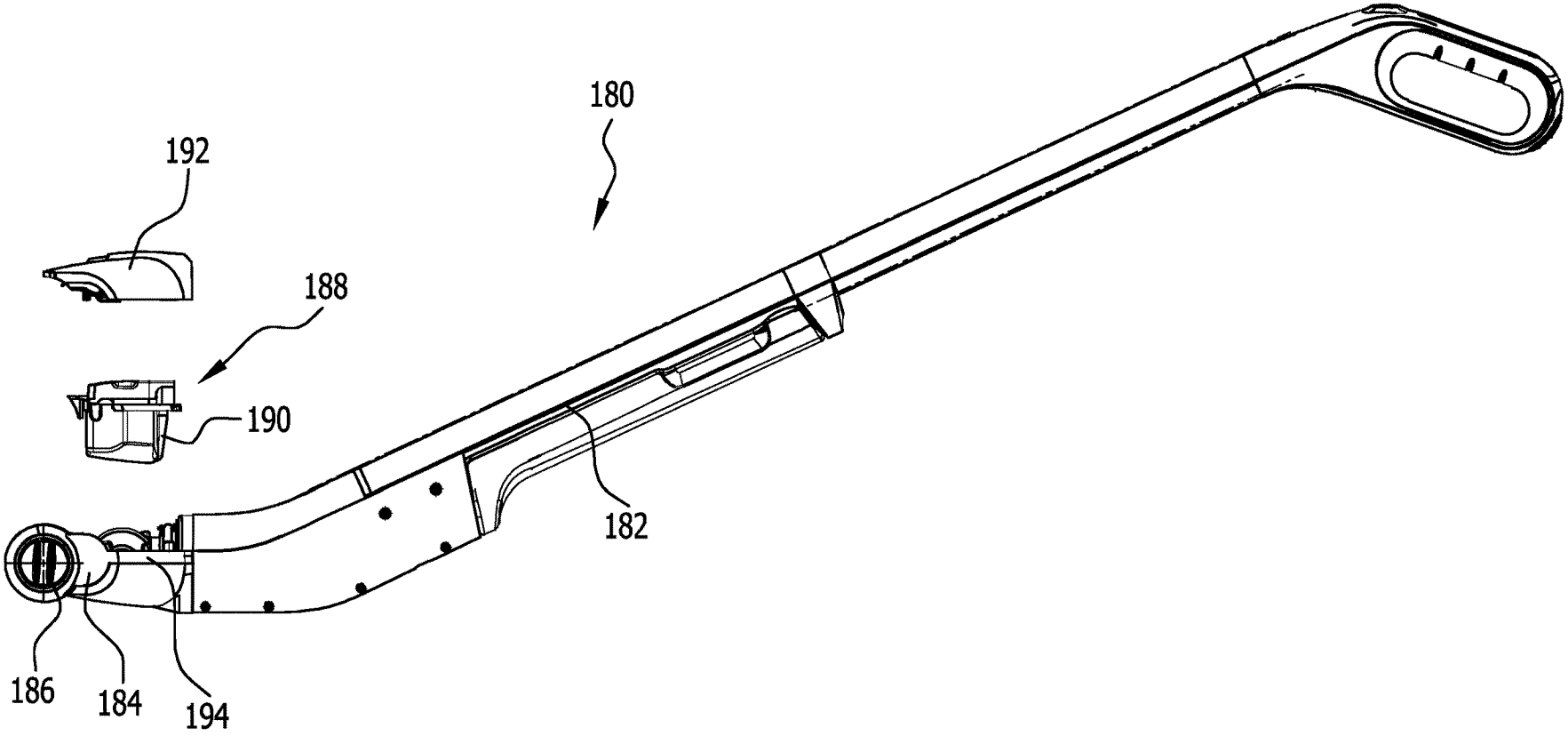
FIG. 9 shows a side view of a second exemplary embodiment of a surface cleaning machine according to the invention with the dirty fluid reservoir device separated, wherein a cover device is detached from a container device.

A second exemplary embodiment of a surface cleaning machine according to the invention, which is shown in FIG. 9 and in partial illustrations in FIGS. 10 to 13 and is designated 180, includes a device body 182 and a cleaning head 184, these basically taking the same form as in the case of the surface cleaning machine 10. Accordingly, a cleaning roller unit 186 is provided that basically takes the same form as the cleaning roller unit 18.

A dirty fluid reservoir device 188 is provided that includes a container device 190 and a cover device 192. The cover device 192 is separable from the container device 190. The container device 190 can be positioned on a receiving region 194 of the cleaning head 184. The cover device 192 can be fixed to the container device 190 and at the same time additionally fixed directly to the receiving region 194 (outside the container device 190).

Figure 10:
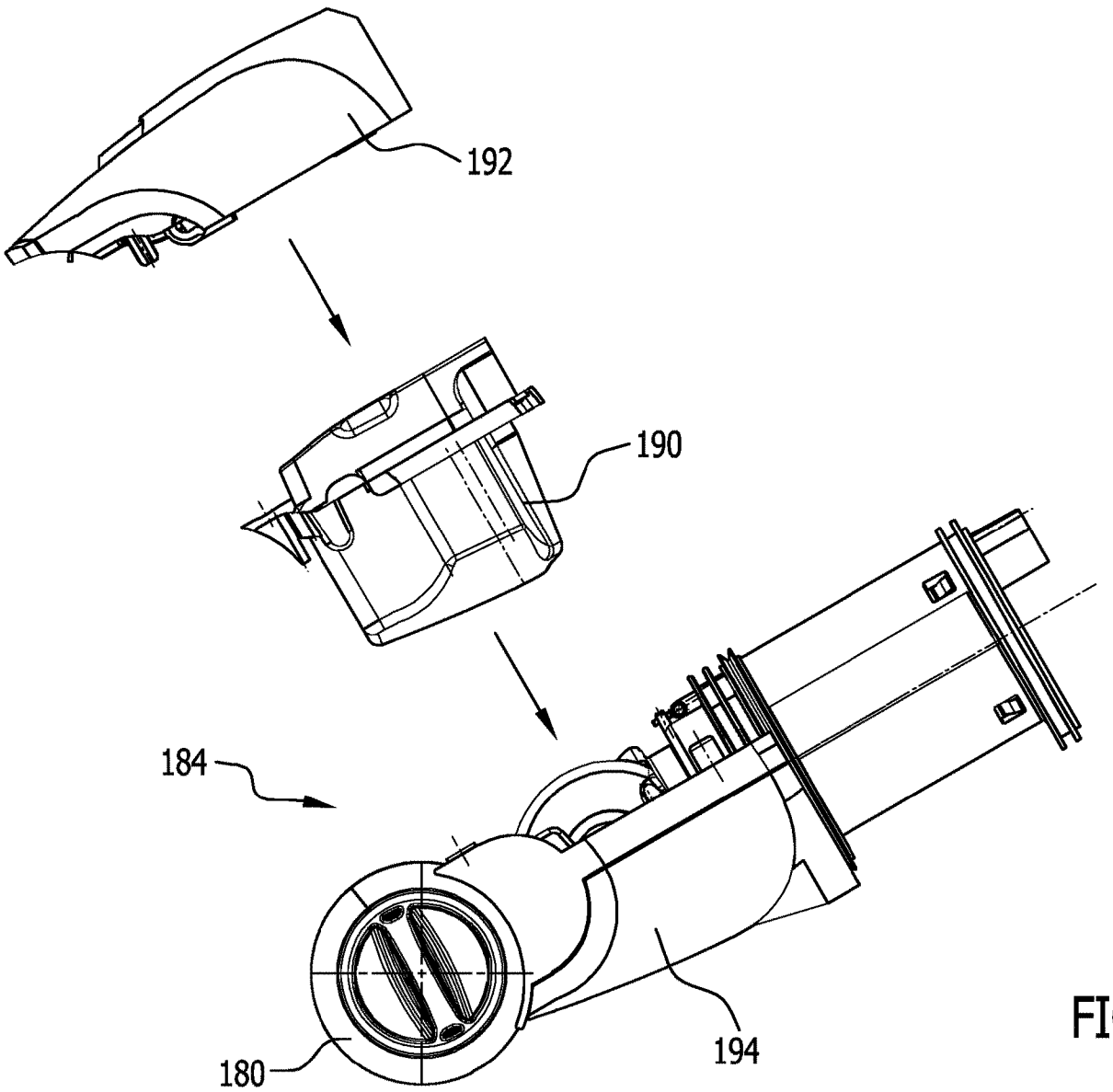
FIG. 10 is an enlarged illustration of a detail of a cleaning head of the surface cleaning machine in FIG. 9 with the container device of the dirty fluid reservoir device detached and with the cover device detached.
Figure 11:
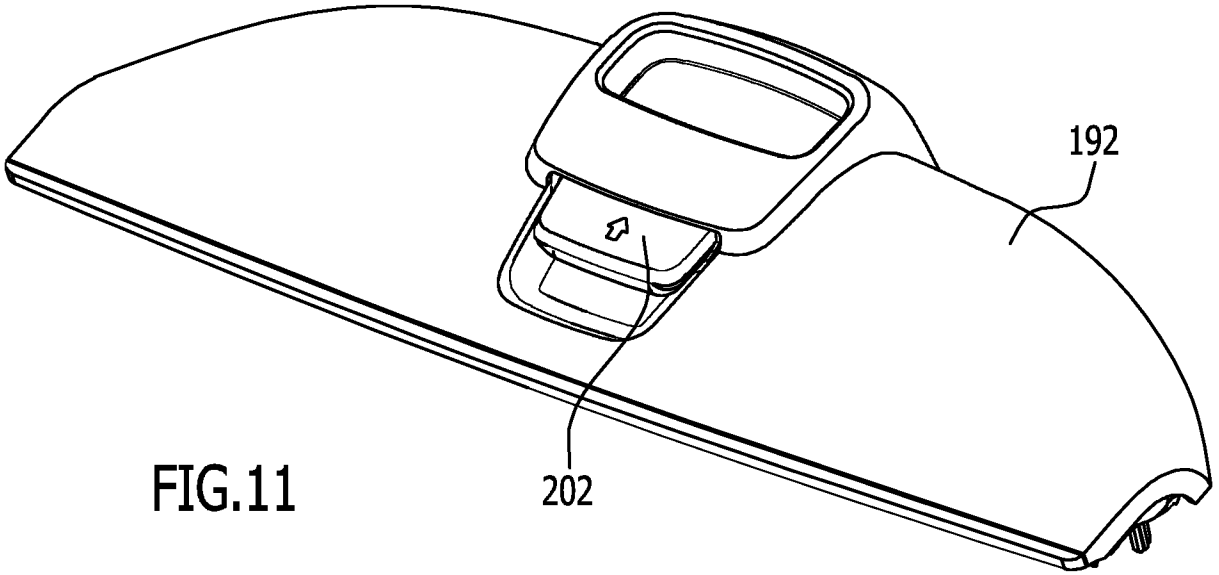
FIG. 11 is a first perspective illustration of the cover device in FIG. 10.
Figure 12:
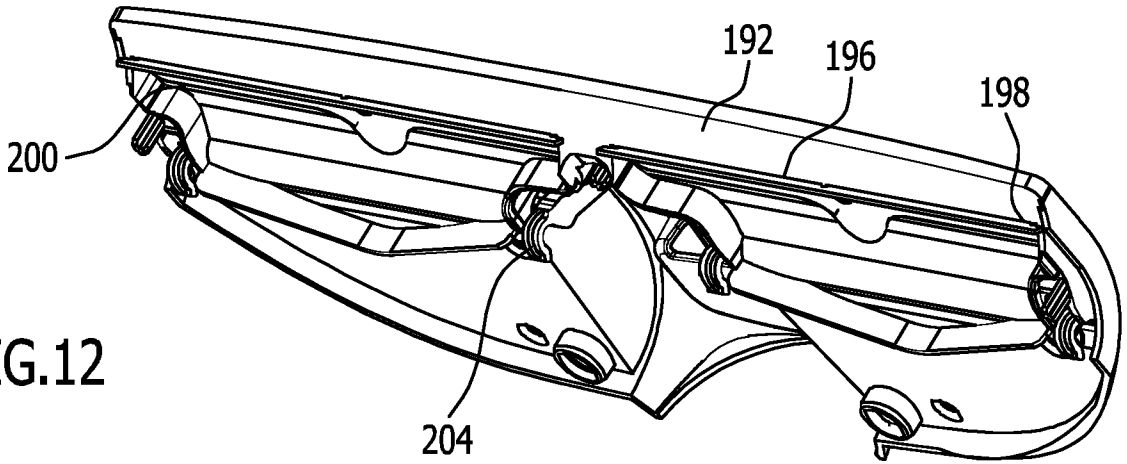
FIG. 12 is a second perspective illustration (in a direction from below) of the cover device in FIG. 10.
Figure 13:
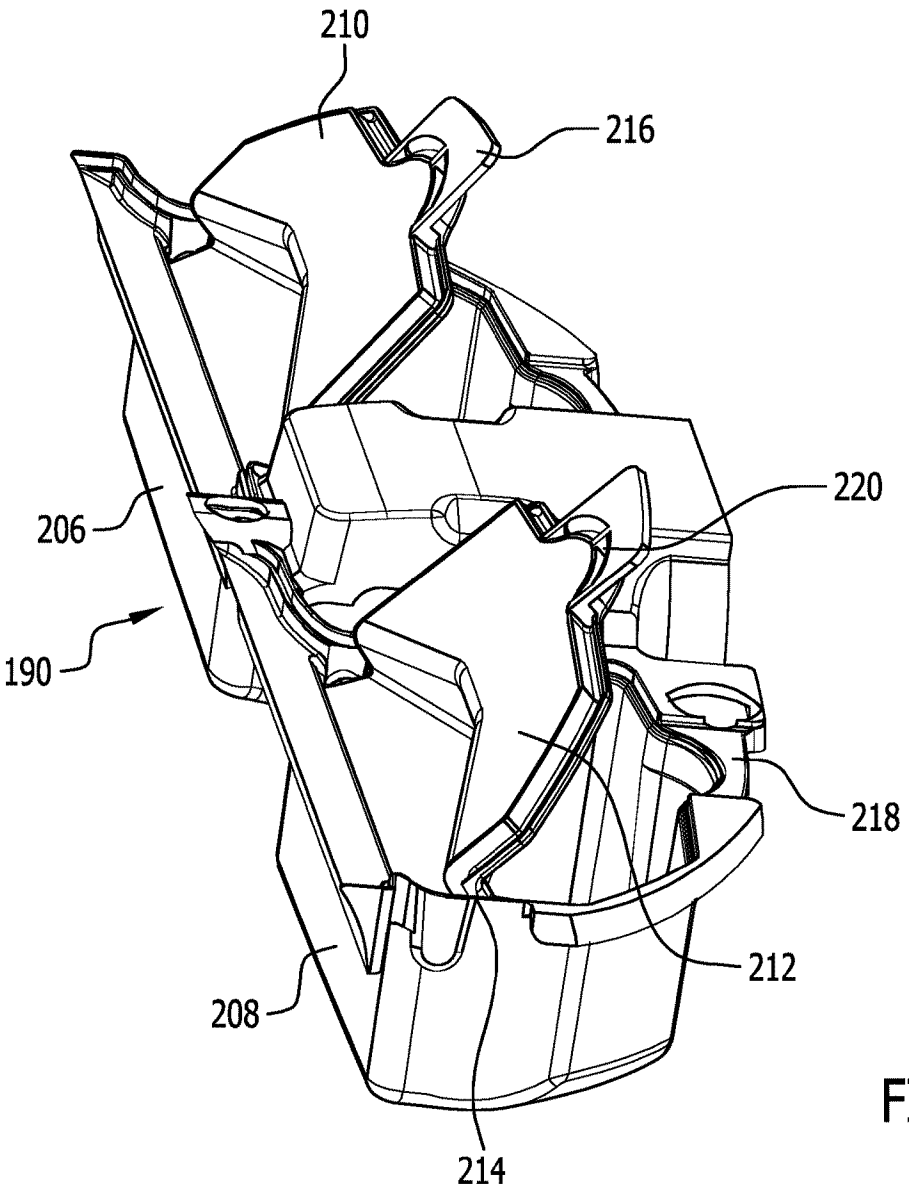
FIG. 13 is a perspective illustration of the container device of the dirty fluid reservoir device in FIG. 10.

This is shown schematically on a larger scale in FIG. 10.

Arranged on the cover device 192 (FIGS. 11, 12) is an orifice device 196 and a duct device 198, fluidically connected thereto. Here, functioning is the same as that described above in relation to the duct device 122 and the orifice device 124 for the surface cleaning machine 10. The duct device 198 is provided for the purpose of being fluidically connected up to the reservoir device 34 for cleaning liquid. Cleaning liquid is provided directly to a facing of the cleaning roller unit 186 through the cover device 192.

Further, there is arranged on the cover device 192 a scraping guide device 200, which corresponds to the scraping guide device 142.

In the exemplary embodiment shown, the scraping guide device 200 is not continuous but is divided into two regions, associated with a respective receiving chamber of the container device 190.

The cover device 192 has a handle element 202 that takes the form in particular of a slide or pivotal element. This is directly coupled to hook elements 204. Like the elements 174 in the case of the dirty fluid reservoir device 66, these may be coupled to one or more corresponding mating elements on the receiving chamber 194 in order to enable the cover device 192 to be locked directly to the receiving region 194 of the cleaning head 184.

The container device 190 (FIG. 13) includes a first receiving chamber 206 and a second receiving chamber 208 for a multi-part cleaning roller unit 186. The formation is the same as that described above in relation to the container device 98.

Arranged on the container device 190 are a first retaining element 210 and a second retaining element 212. Here, the first retaining element 210 is arranged on the first receiving chamber 206 and the second retaining element 212 is arranged on the second receiving chamber 208.

The first retaining element 210 and the second retaining element 212 are each positioned on the respective receiving chamber 206 and 208 such that they are pivotal about a pivot bearing 214.

Here, the respective pivot bearing 214 takes a form such that the respective retaining element 210 or 212 is also separable as a whole.

The first retaining element 210 and the second retaining element 212 each have a tab 216. A respective abutment region 218 for the respective tab 216 is formed on the first receiving chamber 206 and the second receiving chamber 208, opposite the pivot bearing 214. The abutment region 218 blocks the respective retaining element 210 and 212 from pivoting further down, and defines a closed "operational position" of the respective retaining element 210, 212 on the first receiving chamber 206 and 208 respectively.

Further, it is possible, using the tab 216, to access the respective retaining element 210 and 212 in a simple manner in order to pivot it open (into the position shown in FIG. 13) or closed (cf. FIG. 10).

It may further be provided for there to be formed in the tab 216 openings 220 through which dirty fluid can then flow into the corresponding receiving chamber space of the first receiving chamber 206 or the second receiving chamber 208 respectively.

When the retaining elements 210, 212 are closed, in particular they form a type of duct wall for a duct through which dirty fluid can flow and can then reach corresponding receiving chamber spaces of the receiving chambers 206, 208.

In one embodiment, it is provided for the retaining elements 210, 212 to be arranged and configured such that, for a normal operation of the surface cleaning machine 180, they have a sloping orientation such that dirty fluid can flow downwards thereon, in relation to the direction of gravity.

Basically, the surface cleaning machine 180 operates in the same way as the surface cleaning machine 10.

In the case of the dirty fluid reservoir device 188, the retaining elements are not arranged on the cover device 192 but on the container device 190.

In principle, this makes it possible (once the cover device 192 has been detached from the cleaning head 184) to remove the container device 190 from the cleaning head 184 with the retaining elements 210, 212 closed—that is to say to remove it in a position in which the respective tabs 216 abut against the associated abutment regions 218. This prevents dirty fluid from slopping out when the container device 190 is removed, or makes it more difficult for this to happen.

For the purpose of emptying the container device 190 of dirty fluid that has been collected, the retaining elements 210, 212 can be pivoted up (FIG. 13) or completely removed. This allows the container device 190 to be washed out in a simple manner for the purpose of cleaning.

Figure 14:
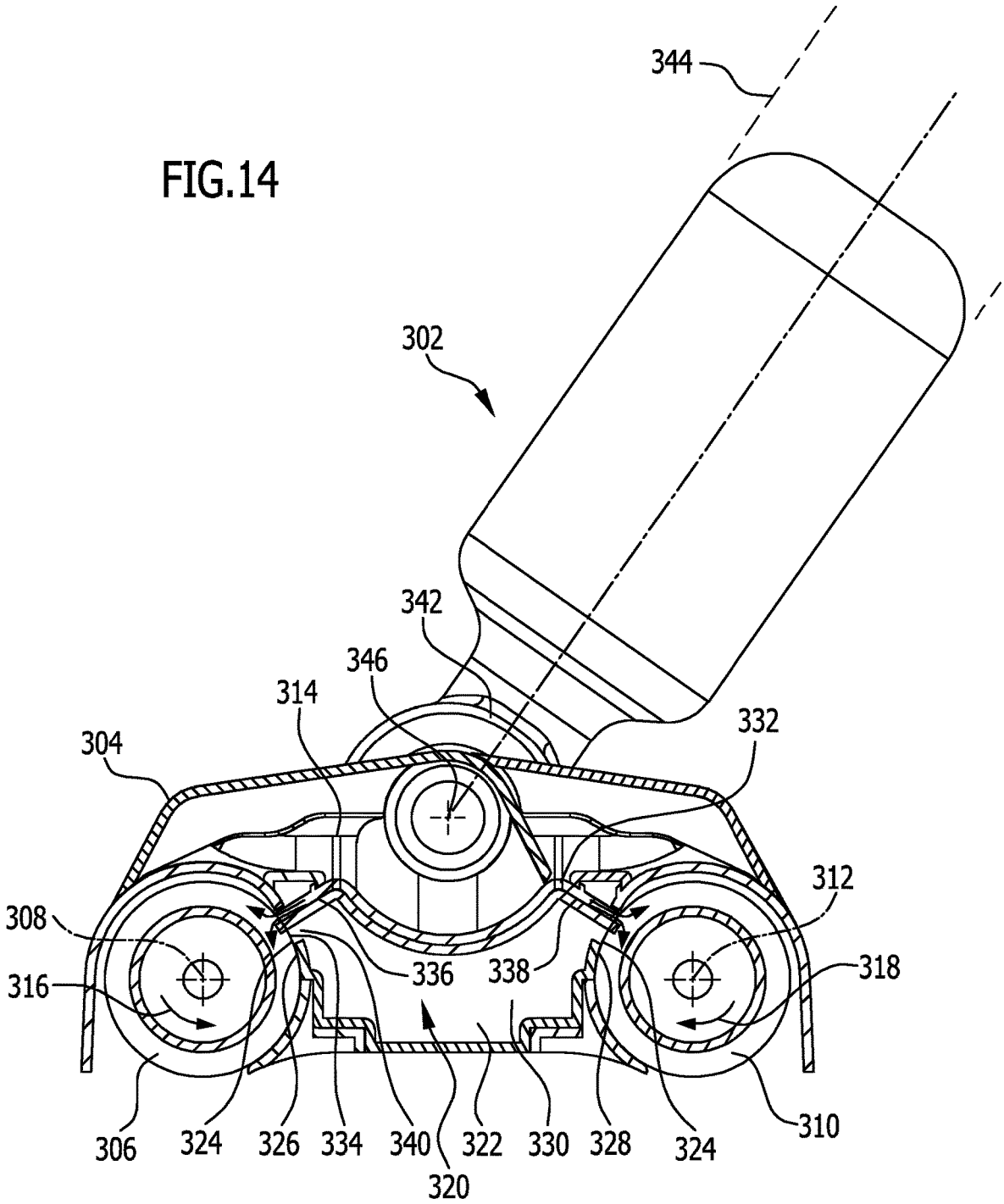
FIG. 14 shows a schematic sectional view of a cleaning head of a third exemplary embodiment of a surface cleaning machine according to the invention.

A further exemplary embodiment of a surface cleaning machine 302 according to the invention, which is shown in a partial illustration in FIG. 14, includes a cleaning head 304.

Arranged on the cleaning head 304 such that it is rotatable about a first axis of rotation 308 is a first cleaning roller unit 306. Further, and spaced apart from the first cleaning roller unit 306, there is arranged on the cleaning head 304 such that it is rotatable about a second axis of rotation 312 a second cleaning roller unit 310. The first axis of rotation 308 and the second axis of rotation 312 are oriented parallel to one another.

The surface cleaning machine 302 has a drive for the first cleaning roller unit 306 and the second cleaning roller unit 310. In one exemplary embodiment, a drive 314 is arranged on the cleaning head 304.

The drive 314 acts, directly or by way of a gear device, on the first cleaning roller unit 306 and the second cleaning roller unit 310 such that they rotate in opposite directions.

In the exemplary embodiment shown in FIG. 14, the first cleaning roller unit 306 has a first direction of rotation 316 and the second cleaning roller unit 310 has a second direction of rotation 318, which is in the opposite direction to the first direction of rotation 316.

Arranged on the cleaning head 304 is a dirty fluid reservoir device 320, which is in particular separable. In one exemplary embodiment, the dirty fluid reservoir device 320 has a common reservoir 322 for the first cleaning roller unit 306 and the second cleaning roller unit 310.

However, in principle it is also possible for the dirty fluid reservoir device 320 to have separate chambers for the cleaning roller units 306 and 310. Further, it is possible for separate chambers to be provided in the case of multi-part cleaning roller units 306 and 310.

The reservoir 322 has an inlet orifice 324. This is composed of a first part 326 associated with the first cleaning roller unit 306, and a second part 328 associated with the second cleaning roller unit 310.

The first part 326 and the second part 328 are oriented parallel to one another and parallel to the axes of rotation 308, 312.

Dirty fluid that is carried along by the first cleaning roller unit 306 can be introduced into the reservoir 322 by way of the first part 326 of the inlet orifice 324. Dirty fluid that is carried along by the second cleaning roller unit 310 can be introduced into the reservoir 322 by way of the second part 328 of the inlet orifice 324.

The dirty fluid reservoir device 320 includes a container device 330 and a cover device 332 for closing the container device 330—that is to say for closing the reservoir 322.

Arranged on the cover device 332, and associated with the first cleaning roller unit 306 and the second cleaning roller unit 310, is a respective orifice device 334 through which cleaning liquid can be supplied to the first cleaning roller unit 306 and the second cleaning roller unit 310 respectively. The respective orifice device 334 is fluidically connected to a duct device 336 that is arranged on the cover device 332 and through which cleaning liquid is suppliable to the orifice device 334.

The duct device 336 is itself fluidically connected to a reservoir for cleaning liquid.

Further provided is a scraping guide device 338, which has a respective region associated with the first cleaning roller unit 306 and the second cleaning roller unit 310.

In the exemplary embodiment shown, the scraping guide device 338 is arranged with its respective regions on the container device 330.

A respective inlet orifice 340 through which dirty fluid is arranged to flow into the container device 330 is arranged on the container device 330, below the scraping guide device 338.

The scraping guide device 338 is arranged with its respective regions that are associated with the first cleaning roller unit 306 and the second cleaning roller unit 310 between the orifice device 334 and the inlet orifice 340.

It may be provided for a rod device 344 to be mounted to pivot by way of a pivot bearing 342 on the cleaning head 304, with a pivot axis 346.

During operation of the surface cleaning machine 302, during which the cleaning roller units 306, 310 stand on the surface to be cleaned, it is then possible for the rod device 344 to be pivoted about the pivot axis 346 in relation to the cleaning head 304.

The pivot axis 346 is in particular parallel to the first axis of rotation 308 and the second axis of rotation 312.

In the dirty fluid reservoir device 320, the orifice device 334 for cleaning liquid is arranged on the cover device 332.

Basically, the surface cleaning machine 302 functions as described above.

During a cleaning procedure, it is supported on the surface to be cleaned by way of the two cleaning roller units 306, 310.

The cleaning roller units 306, 310 are wetted using cleaning liquid from the orifice device 334. Dirty fluid is introduced into the container device 330 at the respective inlet orifice 340.

Figure 15:
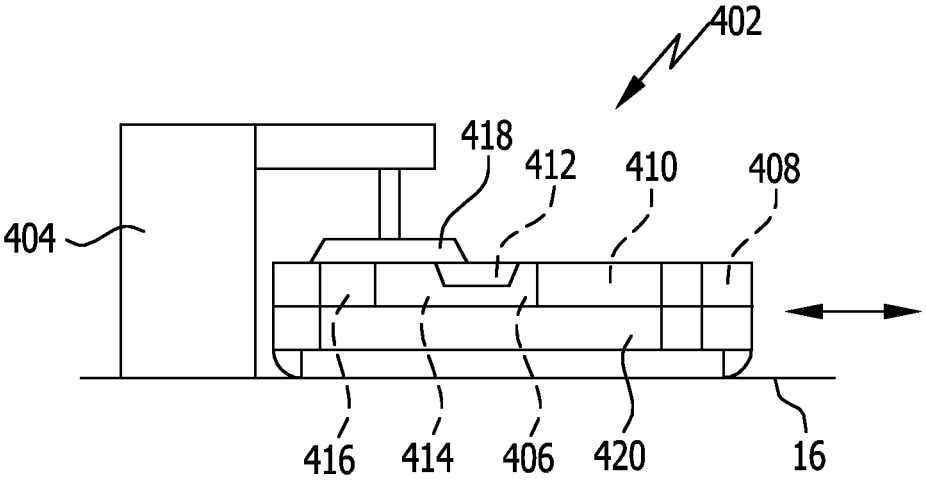
FIG. 15 is a schematic illustration of a fourth exemplary embodiment of a surface cleaning machine according to the invention, with a stationary station and a self-propelling cleaning head.
Figure 16:
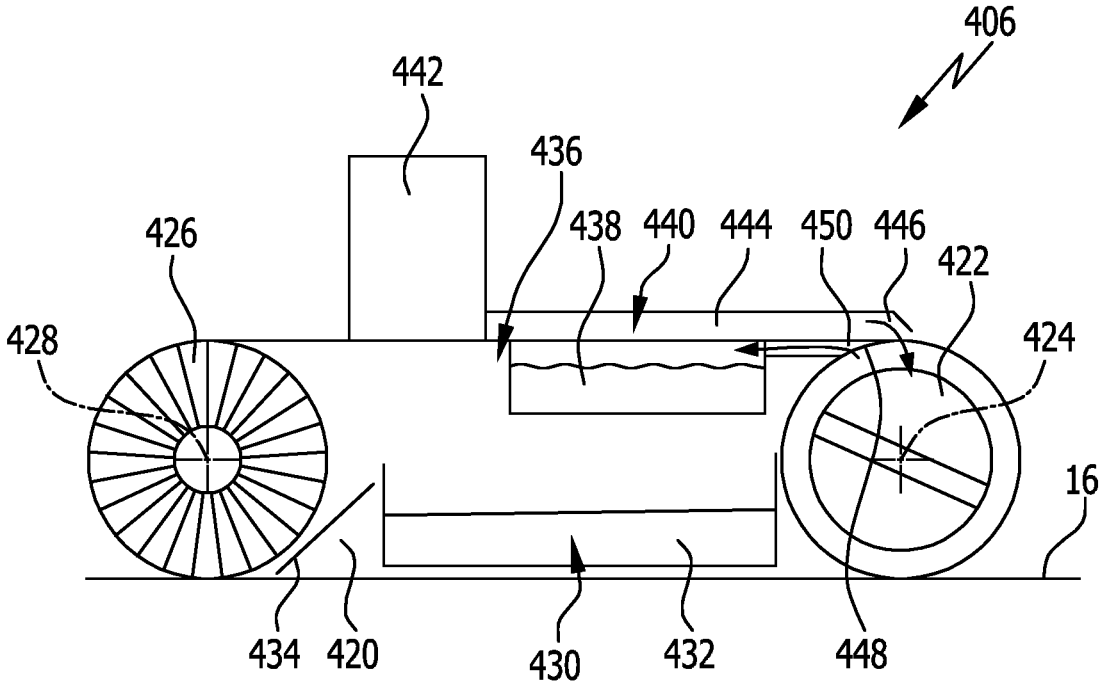
FIG. 16 shows a schematic sectional view of an exemplary embodiment of a self-propelling cleaning head.

A further example of a cleaning machine 402 (FIGS. 15, 16) includes a stationary station 404 (docking station) and a cleaning head 406. The cleaning head 406 takes a self-propelling and self-steering form. It can independently (automatically) carry out cleaning procedures, and in particular mopping procedures, on the surface 16 to be cleaned.

The cleaning head 406 includes a cleaning roller unit 408, a drive motor 410 for the cleaning roller unit 408, a battery device 412 for supplying the drive motor 410 with electrical energy, a dirty fluid reservoir device 414 for receiving dirty fluid, and a reservoir device 416 for cleaning liquid.

The dirty fluid reservoir device 414 and/or the reservoir device 416 for cleaning fluid are arranged on the cleaning head 406 in particular such that they are separable.

The stationary station 404 can fulfil various tasks, such as depositing (storing) the cleaning head 406 in a non-cleaning operation; charging the rechargeable battery device 412; discharging or partially discharging the battery device 412 once a cleaning operation is terminated; emptying the dirty fluid reservoir device 414 once a cleaning operation has ended; filling the reservoir device 416 for cleaning fluid; cleaning the cleaning roller unit 408 once a cleaning operation has terminated.

In particular, there is provided a device that makes it possible for the cleaning head 406 to return automatically to the stationary station 406 "as required", such as if a lower threshold for charging the battery device 412 is detected, and/or if an upper threshold for a filling level of the dirty fluid reservoir device 414 is reached, and/or if a lower threshold for filling the reservoir device 416 is reached.

In one exemplary embodiment, there is arranged on the cleaning head 406 a connector 418 by way of which the stationary station 404 can act on the cleaning head 406, for example for charging (or discharging) the battery device 412, or for the purpose of emptying the dirty fluid reservoir device 414, or for the purpose of filling the reservoir device 416.

In this case, a single connector 418 may be provided with different sub-connectors, or separate connectors may be provided accordingly.

In a cleaning operation, the cleaning head 406 travels over the surface 416 to be cleaned. One or more cleaning rollers of the cleaning roller unit 408 are "wetted" using cleaning liquid of the reservoir device 416.

Dirt that is loosened from the surface 16 to be cleaned is carried along by the cleaning roller unit 408, removed at a scraper, which may in particular be permanently connected to the dirty fluid reservoir device 414, and conveyed into the dirty fluid reservoir device 414.

As a result of taking a self-propelling and self-steering form, the cleaning head 406 can carry out cleaning actions and in particular mopping actions automatically, as a "mopping robot".

In one embodiment (FIG. 16), the cleaning head 406 includes a device body 420. A cleaning roller unit 422 is mounted on this device body 420 such that it is driven in rotation about an axis of rotation 424. A corresponding drive is not drawn in in FIG. 16.

The cleaning roller unit 422 takes the form of a mopping roller unit.

Further, a swept material roller unit 426 is mounted on the device body 420 such that it is rotatable about an axis of rotation 428. The axes of rotation 424 and 428 are in particular parallel to one another.

A travelling movement of the cleaning head 406 is driven by way of rotation of the cleaning roller unit 422 and/or the swept material roller unit 426.

Associated with the swept material roller unit 426 is a receiving container 430 for sweepings 432. The receiving container 430 is arranged on the device body 420. There is provided a swept material edge 434 that is arranged in particular between the swept material roller unit 426 and the receiving container 430 and by which sweepings can be conveyed into the receiving container 430.

Further, arranged on the device body 420 is a dirty fluid reservoir device 436. This includes a container device 438 and a cover device 440 for closing the container device 438. Arranged on the device body 420 is a reservoir body 442 for cleaning liquid. Arranged on the cover device 440 is a duct device 444 that is fluidically connected to the reservoir device 442. Further, arranged on the cover device 440 is an orifice device 446 that is fluidically connected up to the duct device 444 and through which cleaning liquid can be supplied directly to the cleaning roller unit 422.

In one exemplary embodiment, there is further arranged on the cover device 440 a scraping guide device 448, which enables dirty fluid to be scraped off the cleaning roller unit 422 and can be introduced into the container device 438 through an inlet orifice 450.

The duct device 444 is arranged, with the orifice device 446, on the cover device 440. This results in a space-saving arrangement.

In particular, the cover device 440 is separable from the device body 420.

It may also be provided for the container device 438 to be separable from the device body 420.

LIST OF REFERENCE NUMERALS

10 Surface cleaning machine (first exemplary embodiment)
12 Device body
14 Cleaning head
16 Surface to be cleaned
18 Cleaning roller unit
20 Longitudinal axis
22 Holding rod device
24 Holding rod
26 Handle
28 Drive motor
30 Housing
32 Holder
34 Reservoir device for cleaning liquid
36 Reservoir receptacle
38 Valve device
39 Filtering device
40 Fluid conduit
42 Facing
44 Battery device
46 Motor spindle
48 Pivot axis
50 Double-headed arrow
52 Inner sleeve
54 Outer sleeve
56 Pivot bearing
58 Axis of rotation
60 Cleaning roller holder
62 Holding region
64 Receiving region
66 Dirty fluid reservoir device
68 Gear device
70 Shaft
72 First part
74 Second part
76 Intermediate region
78 Sleeve
80 First end face
82 Second end face
84 Base
86 Receiving region wall
88 Receiving chamber
90 Side
92 Removing/inserting direction
98 Container device
100 Cover device
102 Collected dirty fluid
104 First receiving chamber
106 First receiving chamber space
108 Second receiving chamber
110 Second receiving chamber space
112 Holder
114 Intermediate space
116 Lug
118 Cylindrical surface
120 Bearing surface
122 Duct device
124 Orifice device
126 Set-down region
128 Flange
130 Sub-region
132 Upper side
134 Connector
136 Mating connector
138 Duct
140 Orifice slot
142 Scraping guide device
144 Wall
146 Separating wall
148 Inlet orifice
150 First side
152 Second side
154 Region of scraping guide device
156 Duct device
158 First duct
160 Second duct
162 First retaining element
164 Second retaining element
166 Pillar
168 Opening
170 Acute angle
172 Fixing device
174 Element
176 Handle element
178 Mating element
179 Direction of rotation
180 Surface cleaning machine (second exemplary embodiment)
182 Device body
184 Cleaning head
186 Cleaning roller unit
188 Dirty fluid reservoir device
190 Container device
192 Cover device
194 Receiving region
196 Orifice device
198 Duct device
200 Scraping guide device
202 Handle element
204 Hook element
206 First receiving chamber
208 Second receiving chamber
210 First retaining element

212 Second retaining element
214 Pivot bearing
216 Tab
218 Abutment region
220 Opening
302 Surface cleaning machine (third exemplary embodiment)
304 Cleaning head
306 First cleaning roller unit
308 First axis of rotation
310 Second cleaning roller unit
312 Second axis of rotation
314 Drive
316 First direction of rotation
318 Second direction of rotation
320 Dirty fluid reservoir device
322 Reservoir
324 Inlet orifice
326 First part
328 Second part
330 Container device
332 Cover device
334 Orifice device
336 Duct device
338 Scraping guide device
340 Inlet orifice
342 Pivot bearing
344 Rod device
346 Pivot axis
402 Surface cleaning machine (fourth exemplary embodiment)
404 Stationary station
406 Cleaning head
408 Cleaning roller unit
410 Drive motor
412 Battery device
414 Dirty fluid reservoir device
416 Reservoir device
418 Connector
420 Device body
422 Cleaning roller unit
424 Axis of rotation
426 Swept material roller unit
428 Axis of rotation
430 Receiving container
432 Swept material
434 Swept material edge
436 Dirty fluid reservoir device
438 Container device
440 Cover device
442 Reservoir device
444 Duct device
446 Orifice device
448 Scraping guide device
450 Inlet orifice

The invention claimed is:

1. A surface cleaning machine, comprising a cleaning head having at least one driven cleaning roller unit;

a dirty fluid reservoir device arranged on the cleaning head; and a scraping guide device for dirty fluid that acts on the at least one cleaning roller unit;

wherein the dirty fluid reservoir device has a container device for dirty fluid and a cover device for the container device;

wherein a duct device for cleaning liquid is arranged on the cover device; and wherein there is arranged on the cover device an orifice device which is fluidically connected to the duct device and via which cleaning liquid is applicable to the at least one cleaning roller unit.

2. The surface cleaning machine according to claim 1, wherein the orifice device for cleaning liquid is arranged and configured such that cleaning liquid is applicable to at least approximately an entire facing length of the at least one cleaning roller unit.

3. The surface cleaning machine according to claim 1, wherein the orifice device has at least one orifice slot.

4. The surface cleaning machine according to claim 3, wherein the at least one orifice slot is of a length that corresponds to at least 80% and preferably at least 90% and preferably 100% of a facing length of a facing region of the at least one cleaning roller unit, wherein the at least one orifice slot is associated with the facing region.

5. The surface cleaning machine according to claim 3, wherein a direction of longitudinal extent of the at least one orifice slot is oriented at least approximately parallel to an axis of rotation of the associated at least one cleaning roller unit.

6. The surface cleaning machine according to claim 1, wherein the cover device is arranged at least one of (i) detachably and (ii) movably on the container device and, when the cover device is open, one or more receiving chamber spaces of the container device are accessible.

7. The surface cleaning machine according to claim 1, wherein, for dirty fluid to enter the container device, an inlet orifice of the dirty fluid reservoir device is arranged on at least one of the container device and the cover device.

8. The surface cleaning machine according to claim 1, wherein the dirty fluid reservoir device as a whole or the container device is arranged detachably on the cleaning head.

9. The surface cleaning machine according to claim 1, wherein the duct device is fluidically connected to a reservoir device for cleaning liquid.

10. The surface cleaning machine according to claim 1, wherein the scraping guide device is arranged on the cover device.

11. The surface cleaning machine according to claim 10, wherein the scraping guide device forms a wall for at least one of (i) the duct device and (ii) for the orifice device for cleaning liquid.

12. The surface cleaning machine according to claim 1, wherein the scraping guide device is arranged between the orifice device for cleaning liquid and an inlet orifice for dirty fluid to the dirty fluid reservoir device.

13. The surface cleaning machine according to claim 1, wherein the scraping guide device has a guide surface for cleaning liquid, for supply to the cleaning roller unit.

14. The surface cleaning machine according to claim 1, wherein the scraping guide device forms, at least in part, a separating wall between the duct device, for supplying cleaning liquid to the cleaning roller unit, and an inlet orifice or inlet region of the dirty fluid reservoir device.

15. The surface cleaning machine according to claim 1, wherein the scraping guide device has a first side with at least one of a diverting surface and a baffle for dirty fluid, and a second side, opposite the first side, with a diverting surface for cleaning liquid.

16. The surface cleaning machine according to claim 1, wherein the cleaning head has a holding region for the cleaning roller unit, and wherein the scraping guide device has a region that projects into the holding region.

17. The surface cleaning machine according to claim 1, wherein the scraping guide device projects into a facing of the cleaning roller unit.

18. The surface cleaning machine according to claim 1, wherein at least one element for retaining dirty fluid in the dirty fluid reservoir device is seated on at least one of the cover device and the container device.

19. The surface cleaning machine according to claim 18, wherein, when there is at least one retaining element arranged on the cover device, it penetrates into an associated receiving chamber of the container device.

20. The surface cleaning machine according to claim 18, wherein the at least one retaining element covers a sub-region of at least one receiving chamber of the container device, wherein at least one of (i) one or more openings that are fluidically connected to the sub-region are arranged on the at least one retaining element, and (ii) one or more openings that are fluidically connected to the sub-region are arranged between the at least one retaining element and a receiving chamber wall.

21. The surface cleaning machine according to claim 20, wherein the at least one opening is at a lower gravitational potential, at least in a sub-region, than an inlet orifice of the dirty fluid reservoir device with reference to a normal operation of the surface cleaning machine.

22. The surface cleaning machine according to claim 18, wherein at least one duct for dirty fluid is arranged between the at least one retaining element and an underside of the cover device.

23. The surface cleaning machine according to claim 22, wherein the at least one duct opens into an inlet orifice of the dirty fluid reservoir device on the inlet side.

24. The surface cleaning machine according to claim 22, wherein the at least one duct opens into one or more openings to a sub-region of the at least one receiving chamber of the container device on the outlet side.

25. The surface cleaning machine according to claim 22, wherein the at least one duct has a bottom wall that forms an acute angle with a bottom wall of the container device.

26. The surface cleaning machine according to claim 18, wherein the at least one retaining element is spaced from an underside of the cover device by one or more pillars on the cover device.

27. The surface cleaning machine according to claim 18, wherein the at least one retaining element is arranged at least one of movably and removably on the container device.

28. The surface cleaning machine according to claim 27, wherein the at least one retaining element is arranged on the container device such that it is pivotal and in particular pivotal about a hinge.

29. The surface cleaning machine according to claim 1, wherein the dirty fluid reservoir device has a plurality of separate receiving chambers that are arranged next to one another in particular in a direction parallel to an axis of rotation of the cleaning roller unit.

30. The surface cleaning machine according to claim 29, wherein the cover device is a common cover device for the receiving chambers, and in particular is formed by a single element.

31. The surface cleaning machine according to claim 29, wherein the cover device includes at least one of the following elements for each receiving chamber:

an orifice slot, a scraping guide device element, a duct device region for cleaning liquid, a retaining element for a corresponding receiving chamber space.

32. The surface cleaning machine according to claim 29, wherein between spaced-apart receiving chambers there is arranged, at least in part, a device for transmitting torque to the cleaning roller unit.

33. The surface cleaning machine according to claim 1, wherein there is arranged on the container device a lug that delimits a holding region for the cleaning roller unit and has in particular a bearing surface for the cover device.

34. The surface cleaning machine according to claim 1, comprising a first fixing device that fixes the container device to the cleaning head, and a second fixing device that fixes the cover device to the container device.

35. The surface cleaning machine according to claim 1, comprising a fixing device for the cover device that fixes the cover device directly to the cleaning head.

36. The surface cleaning machine according to claim 35, wherein the container device is fixable to the cleaning head by way of the cover device.

37. The surface cleaning machine according to claim 35, wherein the fixing device for the cover device has at least one element that is applied to a mating element of the cleaning head that is not part of the container device, wherein the at least one element and the mating element are movable relative to one another.

38. The surface cleaning machine according to claim 1, wherein the at least one cleaning roller unit includes a multi-part cleaning roller.

39. The surface cleaning machine according to claim 1, wherein, during the cleaning operation, the surface cleaning machine is supported on the surface to be cleaned solely by way of the at least one cleaning roller unit, and in particular a single cleaning roller unit.

40. The surface cleaning machine according to claim 1, comprising a first cleaning roller unit and a second cleaning roller unit between which the dirty fluid reservoir device is arranged.

41. The surface cleaning machine according to claim 40, wherein the first cleaning roller unit and the second cleaning roller unit rotate in opposite directions.

42. The surface cleaning machine according to claim 1, taking the form of a manually guided or hand-held machine.

43. The surface cleaning machine according to claim 42, comprising a rod device on which the cleaning head is seated.

44. The surface cleaning machine according to claim 1, wherein the cleaning head is self-propelling and self-steering.

* * * * *